US008512128B2

(12) United States Patent
Sasaki et al.

(10) Patent No.: US 8,512,128 B2
(45) Date of Patent: Aug. 20, 2013

(54) GAME MACHINE AND COMPUTER PROGRAM THEREOF

(75) Inventors: Yosuke Sasaki, Tokyo (JP); Shinichi Ishii, Tokyo (JP); Makato Ando, Tokyo (JP); Yaku Hiranbe, Tokyo (JP); Tomoaki Hirai, Tokyo (JP); Emiko Miyaji, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 0 days.

(21) Appl. No.: 13/329,566

(22) Filed: Dec. 19, 2011

(65) Prior Publication Data

US 2012/0149455 A1 Jun. 14, 2012

Related U.S. Application Data

(62) Division of application No. 12/531,477, filed as application No. PCT/JP2008/053639 on Feb. 29, 2008.

(30) Foreign Application Priority Data

Mar. 19, 2007 (JP) ..... 2007-070768
Mar. 19, 2007 (JP) ..... 2007-070771
Mar. 19, 2007 (JP) ..... 2007-070782

(51) Int. Cl.
*A63F 9/24* (2006.01)

(52) U.S. Cl.
USPC ..... 463/21

(58) Field of Classification Search
USPC ..... 463/21
See application file for complete search history.

(56) References Cited

U.S. PATENT DOCUMENTS 5,833,537 A * 11/1998 Barrie ..... 463/21
2004/0097280 A1 5/2004 Gauselmann
2004/0266520 A1 12/2004 Aida
2005/0192083 A1 9/2005 Iwamoto
2007/0123345 A1 5/2007 Sato
2007/0167201 A1* 7/2007 Schultz ..... 463/1
2010/0197377 A1* 8/2010 Aoki et al. ..... 463/20

FOREIGN PATENT DOCUMENTS

JP 2004-201751 A 7/2004

OTHER PUBLICATIONS

Chinese Office Action from corresponding Chinese Patent Application No. 201110251269.3 dated Jan. 14, 2013.
Office Action for Taiwanese Patent Application No. 097109381 (May 20, 2013).

* cited by examiner

*Primary Examiner* — Corbett B Coburn
(74) *Attorney, Agent, or Firm* — Edwards Wildman Palmer LLP; Brian R. Landry

(57) ABSTRACT

An aspect of the invention provides a game machine including: a second game chance control device that generates at least one game chance that is allowed to establish a predetermined winning condition in a game within a predetermined range provided to a player in exchange for a game value; a symbol arrangement control device that determines types of symbols to be arranged on a predetermined area on a game screen with a predetermined positional relationship according to the generation of the game chance; and a first winning determining device that determines whether the winning condition is established based on the types and the arrangement of the symbols arranged on the predetermined area.

10 Claims, 21 Drawing Sheets

FIG.4

TB1

| APPEARING SYMBOLS | RANDOM NUMBERS |
|---|---|
| 1 FREE SYMBOL | 00000…0 |
| ⋮ | 00000…1 |
| 2 FREE SYMBOLS | |
| ⋮ | ⋮ |
| 3 FREE SYMBOLS | |
| ⋮ | |
| WILD 3 SYMBOLS | |
| ⋮ | |
| WILD 5 SYMBOLS | |
| ⋮ | |
| WILD 10 SYMBOLS | |
| ⋮ | |
| WILD 20 SYMBOLS | |
| ⋮ | |
| NORMAL SYMBOL | |
| ⋮ | |
| NORMAL SYMBOL | 11111…1 |

FIG.6

TB2

| SYMBOLS | RANDOM NUMBER |
|---|---|
| 7 | 00000…0 |
| ⋮ | 00000…1 |
| 7 | |
| BAR | ⋮ |
| ⋮ | ⋮ |
| BAR | ⋮ |
| ⋮ | ⋮ |
| CHERRY | ⋮ |
| ⋮ | ⋮ |
| CHERRY | 11111…1 |

FIG.8

120

CONNECT BONUS

| | | | | | | | BAR | 7 |
|---|---|---|---|---|---|---|---|---|
| NINE | × 1000 | × 1500 | × 2000 | × 2000 | × 3000 | × 4000 | × 5000 | × 10000 |
| EIGHT | × 100 | × 150 | × 200 | × 250 | × 300 | × 400 | × 500 | × 1000 |
| SEVEN | × 20 | × 30 | × 40 | × 50 | × 60 | × 80 | × 100 | × 200 |
| SIX | × 5 | × 8 | × 10 | × 12 | × 15 | × 20 | × 25 | × 50 |
| FIVE | × 2 | × 3 | × 4 | × 5 | × 6 | × 8 | × 10 | × 20 |
| FOUR | × 1 | × 1 | × 1 | × 1 | × 1 | × 2 | × 3 | × 6 |
| THREE | — | — | — | — | — | × 1 | × 1 | × 2 |

TB3

| NEXT ODDS | 50 |
|---|---|
| 7 | 30 |
| BAR | 20 |
| 8 | 10 |
| BELL | 5 |
| WATERMELON | 3 |
| PLUM | 2 |
| ORANGE | 1 |
| CHERRY | 1 |

FIG.13

TB4

| NUMBER OF FREE SYMBOLS | NUMBER OF FREE GAMES |
|---|---|
| 1 | 5 |
| 2 | 10 |
| 3 | 15 |

Number of Wild Times = 1

Number of Wild Times = 1

Number of Wild Times = 0

Number of Wild Times = 0

GAME MACHINE AND COMPUTER PROGRAM THEREOF

This application is a divisional application of U.S. patent application Ser. No. 12/531,477 filed Sep. 15, 2009, which is the U.S. National Phase Application under 35 U.S.C. §371 of International Patent Application No. PCT/JP2008/053639 filed Feb. 29, 2008, which claims the benefit of Japanese Patent Application No. 2007-070768 filed Mar. 19, 2007, Japanese Patent Application No. 2007-070771 filed Mar. 19, 2007, and Japanese Patent Application No. 2007-070782 filed Mar. 19, 2007, all of which are incorporated by reference herein. The International Application was published in Japanese on Sep. 25, 2008 as WO2008/114596 A1 under PCT Article 21(2).

TECHNICAL FIELD

The present invention relates to a game machine that generates a dividend according to achievement of a winning combination, or determines whether a winning condition is established based on types and arrangements or arrays of symbols displayed on a game screen.

BACKGROUND ART

For example, in publicly known game machines such as slot game machines, a correspondence relationship between winning combinations and dividend values (odds, a number of dividends or dividend amount) is preset and when any winning combination is achieved, a dividend is given to a player according to the dividend value set for this winning combination. In these game machines, the dividend value is generally varied according to a probability of achievement in a winning combination. Also in publicly known game machines, when a predetermined condition is established in a game, an arrangement order of odds is shuffled by using random numbers so that a correspondence relationship between winning combinations and odds is changed (for example, see Patent Document 1).

Further, in publicly known game machines, when symbols to be arranged on a predetermined area on a game screen in a predetermined positional relationship (matrix pattern as one example) is drawn randomly from predetermined types of symbols and then the types and the arrangement of these symbols achieve predetermined winning combinations, winning is determined In some of such a kind of game machines, not only normal symbols are available as one type of symbols in a determination of success or failure of a winning condition; also, common symbols that are available as two or more types (typically all types) of normal symbols in the determination of the success or failure of the winning condition are included in symbol candidates to be selected. When a predetermined condition is established, the common symbols are arranged on a predetermined area and the probability of establishment of the winning condition is heightened (for example, see Patent Document 2).

Further, in publicly known game machines, when symbols to be arranged on a predetermined area on a game screen in a predetermined positional relationship (a matrix pattern as one example) is drawn randomly from predetermined types of symbols and the same type of symbols whose number is necessary for winning are aligned on a predetermined winning line, a determination is made that a winning combination as a winning condition is achieved. In some of this type of game machines, when a winning combination or a winning condition is about to be established, but winning is narrowly missed (e.g., a case where only one different type of symbol is mixed on a winning line), the user's expectation for winning is heightened by additionally giving a drawing chance (for example, see Patent Document 3).

Patent Document 1: Japanese Patent Application Laid-Open No. 2004-033615

Patent Document 2: Japanese Patent Application Laid-Open No. 2004-173950

Patent Document 3: Japanese Patent Application Laid-Open No. 2005-312481

DISCLOSURE OF THE INVENTION

Problem to be Solved by the Invention

In game machines where dividend values are set for winning combinations, respectively, a dividend list where the winning combinations are related with the dividend values is generally provided on suitable positions of the game machines. For easy understanding of the correspondence relationship between the winning combinations and the dividend values, constant regularity or order is normally set to the array of the winning combinations in the dividend list. In a typical example, the regularity or the order is set so that the winning combinations are arranged in decreasing order of the probability of the achievement, and the dividend values related to the winning combinations are set in increasing order. Players frequently enjoy understanding the correspondence relationship between the winning combinations and the dividend values, based not only on the correspondence relationship between the winning combinations and the dividend values, but also regularity between the dividend values. For this reason, when the arrangement order of the dividend values is changed by random numbers or the like, it is difficult to understand the correspondence relationship after the change immediately, and thus this might confuse the players. On the other hand, when the dividend values are integrally multiplied uniformly, the correspondence relationship between the winning combinations and the dividend values after the change is easily understood. However, if the dividend values such as odds increase by integral multiplication, the dividend values cannot be finely controlled. A case where an absolute amount of dividends such as the number of dividends or dividend amounts is displayed as the dividend values to be related with the winning combinations and displayed instead of odds on the dividend list also causes the similar problem.

When common symbols are arranged only at one game chance, namely, one winning determination chance, user's expectation for winning cannot be sufficiently heightened. On the other hand, when common symbols can be used at game chances without limit, a high probability state undesirably continues for long time, and a difference in the winning probability between the case where the common symbols appears and the case where they do not appear expands. That is to say, the high probability state cannot be flexibly and suitably controlled.

Even when the same type of symbols appear partially on an array achieving a winning combination, drawing from all symbols is repeated in next drawing. In this case, even if next drawing is given as perk due to near-missing of winning, an impression that a state of an near-winning condition is less likely might be given to players, and thus the players' expectation cannot be sufficiently heightened. When the symbols that are aligned on the winning line are excluded from symbols to be drawn and only different types of symbols are used as the symbols to be drawn next, the remaining symbols may be aligned. For this reason, the state that the winning condition is about to be established is not diminished. In this case, however, since some types of symbols are already decided, the probability of achieving a winning combination at the next time is limited. When only winning combinations whose dividends are smaller are achieved, the players' expectation is diminished.

It is an object of the present invention to provide (i) a game machine that can allow a player to relatively easily understand a correspondence relationship between winning combinations and dividend values even when the correspondence relationship is changed and can finely control dividend values and (ii) a computer program to be used in the game machine. Further, it is another object of the present invention to provide (i) a game machine that can sufficiently heighten player's expectation for winning using common symbols and can flexibly and suitably control a high probability state generated by the common symbols and (ii) a program to be used therein. Further, it is another object of the present invention to provide (i) a game machine that can sufficiently heighten player's expectation for a next drawing chance without giving an impression such that a state of almost establishment of a winning condition is diminished to the player and (ii) a program to be used therein.

Means to Solve the Problem

In order to solve the above problems, a game machine according to a first aspect of the present invention comprises: a first game chance control device that generates a game chance which is allowed to achieve at least one winning combination in winning combinations whose achievement probability varies in a game within a predetermined range to be provided to the player in exchange for a game value; a dividend value control device that sets a correspondence relationship between the winning combinations and the dividend values for the player; a dividend display control device that displays a dividend list where the winning combinations are related with the dividend values on a predetermined display device according to the correspondence relationship set by the dividend value control device; a dividend creating device that generates the dividend for the player corresponding to the achieved winning combination according to the correspondence relationship set by the dividend value control device when any winning combination is achieved; and a condition determining device that determines whether a predetermined dividend change condition is established in the game within the predetermined range, wherein the dividend value control device changes the correspondence relationship so that every time when the dividend change condition is established, a column of the dividend values shifts to one end side of an arrangement direction of the winning combinations on the dividend list, and a new dividend value is credited to a blank space generated on the other end portion in the arrangement direction of the dividend list according to the shift.

According to the game machine of the present invention, when a winning combination is achieved at the chance generated by the first game chance control device, the dividend generating device generates a dividend corresponding to the winning combination according to the correspondence relationship between the winning combinations and the dividend values set by the dividend value control device. The correspondence relationship between the winning combinations and the dividend values is displayed in advance on the dividend list by the dividend display control device. A player understands the relationship between the winning combinations and the dividend values based on the dividend list so as to enjoy the game. When the dividend change condition is established, the correspondence relationship between the winning combinations and the dividend values is changed, and accordingly the correspondence relationship displayed on the dividend list also changes. The correspondence relationship is changed in such a manner that the column of the dividend values displayed on the divided list before the change shifts to the arrangement direction of a winning combination. As a result, regularity or order between the dividend values is maintained before and after the change in a certain range on the dividend list (a constant range from one end portion). Therefore, even when the correspondence relationship between the winning combinations and the dividend values is changed, the player can be allowed to comparatively easily understand the correspondence relationship. Particularly when a shift amount of the column of the dividend values on the dividend list is predetermined, the correspondence relationship after the change can be estimated before the change. When the dividend change condition is established, the player can be allowed to understand how the dividend values change more easily. Further, when a rate of change or a change amount between the dividend values is finely set, the change in the dividend values before and after the change in the correspondence relationship can be repressed small. As a result, the dividend values can be finely controlled.

In the game machine according to the first aspect of the present invention, the dividend value control device determines a new dividend value, which should be credited to the blank space at the time when the dividend change condition is established at the next time, at a stage before the establishment of the dividend change condition, and the dividend display control device may display the new dividend value as a dividend value, which should be credited to the blank space at the time when the dividend change condition is established at the next time, on the display device. In this case, the dividend value which should be credited to the dividend list at the time when the dividend change condition is established at the next time, is presented to the player in advance. For this reason, the player can be allowed to understand the correspondence relationship between the winning combinations and the dividend values after the change more easily.

In the aspect, the dividend display control device may display the dividend value, which should be set in the blank space at the time when the dividend change condition is established at the next time, so that the dividend value is adjacent to the dividend value arranged on the other end of arrangement direction in the dividend list. In this case, the player can be allowed to easily understand that the new dividend value displayed adjacently to the dividend value on the other end in the dividend list is a value to be credited to the blank space generated due to the change of the correspondence relationship.

In the game machine according to the first aspect according to the present invention, the dividend display control device sets an arrangement order of the winning combinations so that the winning combinations whose achievement probability is lower are closer to the other end of the arrangement direction in the dividend list, and the dividend value control device may change the correspondence relationship so that an expectation value of the dividend becomes larger every time when the dividend change condition is established. In the aspect, the correspondence relationship between the winning combinations and the dividend values is changed so that the expectation value of the dividend becomes larger every time when the dividend change condition is established. Further, since the winning combinations whose probability is lower are arranged so as to be closer to the other end in the dividend list, it is possible to make the player easily understand that the correspondence relationship is changed so that the expectation value of the dividend becomes large when the dividend change condition is established by seeing regularity or order present between the divided values before the change. As a result, a excitement of the game can be heightened by attracting the player's interest to success or failure of the dividend change condition.

In the game machine according to the first aspect of the present invention, the dividend value control device may set the new dividend value, which is credited to the blank space at the time when the dividend change condition is established, to a value not less than the highest dividend value displayed on the dividend list before the establishment of the dividend change condition. In the aspect, when the dividend change condition is established, the player can be allowed to understand that higher dividend can be expected before the establishment of the dividend change condition. As a result, a excitement of the game can be heightened by attracting the player's interest to the success or failure of the dividend change condition.

In the first aspect of the present invention, it may be that the game machine comprises a dividend candidate data saving device that saves dividend candidate data in which dividend candidate values whose number is larger than the number of the winning combinations are arranged in predetermined order, Wherein the dividend value control device selects a series of dividend candidate values whose number is larger than the number of the winning combinations by predetermined number as a selected dividend value group from the dividend candidate data, and set the correspondence relationship by further selecting a series of dividend candidate values whose number is the same as the number of the winning combinations from the head dividend candidate values in the selected dividend value group as dividend values to be displayed with them being related with the winning combinations on the dividend list, and selects dividend candidate values included in a range of the predetermined number starting from the tail end of the selected dividend value group as the new dividend value which should be credited to the blank space when the dividend change condition is established at the next time, and changes the correspondence relationship by setting a range of the selected dividend value group selected from the divided candidate data with the range being shifted by the predetermined number when the dividend change condition is established, and determines a new dividend value which should be credited to the blank space when the dividend change condition is further established after the change.

In the aspect, the range of the selected candidate value group set on the dividend candidate data is shifted by the predetermined number every time when the dividend change condition is established, so that the correspondence relationship between the winning combinations and the dividend values in the present invention can be changed and the new divided value can be determined. Since the correspondence relationship is set by using the common dividend candidate data before and after the change in the correspondence relationship, the inventors do not have to create data tables which are different according to a difference in the correspondence relationship between the winning combinations and the dividend values in advance. Therefore, the number of development steps and a data amount can be reduced.

In the aspect using the dividend candidate data, the dividend display control device may display the new dividend value as the dividend value, which should be credited to the blank space when the dividend change condition is established at the next time, on the display device. In this case, since the new dividend value to be credited to the blank space is displayed in advance, as described above, the player can be allowed to easily understand the correspondence relationship between the winning combinations and the dividend values after the change. Further, the dividend display control device may display the dividend value, which should be set on the blank space when the dividend change condition is established at the next time with the dividend value being adjacent to the dividend value displayed on the other end of the arrangement direction in the dividend list. In this case, the player can be allowed to easily understand that the new dividend value displayed adjacently to the dividend value on the other end of the dividend list is a value which should be credited to the black space generated due to the change in the correspondence relationship.

In the aspect using the dividend candidate data, it may be that the dividend display control device sets arrangement order of the winning combinations so that the winning combinations whose achievement probability is lower are closer to the other end of the arrangement direction in the dividend list, and the dividend candidate data has a data structure such that the dividend candidate values are arranged so that the closer the range of the selected dividend value group shifts from the head to the tail end, the higher the expectation value of dividend becomes. In this case, the change such that the expectation value of dividend becomes higher every time the dividend change condition is established can be realized only by shifting the range of the selected dividend value group set on the dividend candidate data every time when the dividend change condition is established. The dividend candidate data may have a data structure such that the dividend candidate values are arranged with them becoming higher towards the tail end from the head. A result, every time when the dividend change condition is established, higher dividend values are set for the winning combinations so that the expectation value of dividend becomes higher.

In the game machine according to the first aspect of the present invention, the first game chance control device may generate an additional game chance which is allowed to achieve at least one of the winning combinations within the same range when a winning combination is achieved in a game within the predetermined range, and the condition determining device may determine that the dividend change condition is established when at least one winning combination is achieved at the additional game chance generated by the first game chance control device. In the aspect, when a winning combination is further achieved at an additional game chance given by the achievement of the winning combination, the determination is made that the dividend change condition is established, so that the dividend value control device changes the correspondence relationship between the winning combinations and the dividend values. Also when the winning combination is established at the additional game chance, the first game chance control device gives an additional game chance, so that the winning combination is repeatedly established in the same range and the correspondence relationship between the winning combinations and the divided values might be repeated changed. Every time when the correspondence relationship is changed, the column of the dividend values shifts to one end and a new dividend value is credited to the blank space on the other end in the dividend list. Even when such a change is repeated, the correspondence relationship between the winning combinations and the dividend values is easily understood. For this reason, even when the repeating frequency is high, the player has less potential for confusion, and the excitement of the game can be further heightened.

In order to solve the above problems, a computer program according to the first aspect of the present invention is constituted to allow a computer provided to a game machine to serve as: a first game chance control device that generates a game chance which is allowed to achieve at least one winning combination in winning combinations whose achievement probability varies in a game within a predetermined range to be provided to a player in exchange for a game value; a dividend value control device that sets a correspondence relationship between the winning combinations and dividend values for the player; a dividend display control device that displays a dividend list where the winning combinations are related with the dividend values on a predetermined display device according to the correspondence relationship set by the dividend value control device; a dividend generating device that generates a dividend for the player corresponding to the achieved winning combination according to the correspondence relationship set by the dividend value control device when any winning combination is achieved; and a condition determining device that determines whether a predetermined dividend change condition is established in the game within the predetermined range, wherein the dividend value control device changes the correspondence relationship so that every time when the dividend change condition is established, a column of the dividend values shifts to one end side of an arrangement direction of the winning combinations on the dividend list, and a new dividend value is credited to a blank space generated on the other end in the arrangement direction of the dividend list according to the shift.

When the computer program of the present invention is executed by the computer provided in the game machine, the game machine of the present invention can be constituted. The computer program of the present invention may be provided to the user with the program being recorded in a recording medium readable by the computer, or may be provided to the user through a wired or wireless communication network.

In order to solve the above problems, a game machine according to a second aspect of the present invention comprises: a game chance control device adapted and configured to generate at least one game chance that is allowed to establish a winning condition in a game provided to a player; a symbol arrangement control device adapted and configured to determine types of symbols to be arranged on a predetermined area on a game screen with a predetermined positional relationship according to the generation of the game chance; and a winning determining device adapted and configured to determine whether the winning condition is established based on the types and the arrangement of the symbols arranged on the predetermined area. The symbol arrangement control device comprises: a symbol drawing device adapted and configured to draw at least one symbol from symbol candidates including normal symbols wild symbols; a symbol arrangement device adapted and configured to arrange the symbols drawn by the symbol drawing device on the predetermined area; a consumption condition determining device adapted and configured to determine whether a predetermined consumption condition is established in the game; and a symbol control device adapted and configured to-control the arrangement of symbols on the predetermined area so that when the wild symbol is arranged on the predetermined area, the effective range of the wild symbol is reduced every time that the consumption condition is established, and even if a new game chance is generated, the wild symbol remains on the predetermined area until the effective range is consumed, and when the effective range is consumed, the wild symbol disappears from the predetermined area.

In the game machine of the present invention, when the game chance control device generates a game chance, the symbol arrangement control device determines types of symbols to be arranged on a predetermined area on a game screen and then the determined symbols are arranged on the predetermined area on the game screen with a predetermined positional relationship. The winning determining device determines success or failure of winning based on the types and arrangement of the symbols. At the symbol type determining process by the symbol arrangement control device, the symbol drawing device draws a wild symbol from symbol candidates, and then the drawn wild symbol can be arranged on the predetermined area. When a predetermined consumption condition is established with the wild symbol being arranged, the wild symbol control device reduces the effective range of the wild symbol accordingly. Even when a new game chance is generated, the wild symbol remains on the predetermined area on the game screen until the effective range consumed. Since the wild symbols are available as two or more kinds of normal symbols, a state that the probability of the establishment of the winning condition is heightened continues until the wild symbols disappear. As a result, user's sense of expectancy for the winning can be further heightened relative to using the wild symbol only once. On the other hand, the high probability state due to the wild symbols can be controlled flexibly and suitably according to the setting of the consumption condition and the effective range.

In the game machine according to the second aspect of the present invention, the effective range is defined by a number of effective times, and the symbol control device is adapted and configured to determine that the consumption condition is established every time the wild symbol is used for the establishment of the winning condition, and reduce the number of effective times one by one. In the aspect, since the number of effective times is reduced one by one every time when the wild symbol is used for the establishment of the winning condition, a relationship between the establishment of the consumption condition and residual of the effective range of the wild symbols is clear, and the player can be allowed to easily understand how long the high probability state due to the wild symbol continues.

In the game machine according to the second aspect of the present invention, the winning determining device is adapted and configured to determine that the winning condition is established when a predetermined number of same types of symbols arranged on the predetermined area form a predetermined array. In the aspect, when the wild symbol is taken into the predetermined array, in the case that the wild symbol and any one type of two or more types of normal symbols included in the range where the wild symbol is available are aligned in one array, the first winning determining device determines that the predetermined array is formed by the same type of symbols.

In the game machine according to the second aspect of the present invention, the game chance control device is further adapted and configured to: generate the new game chance in the game when the winning condition is established; and end the game when the winning condition is not established, wherein the symbol control device is adapted and configured to erase the wild symbol from the predetermined area when the winning condition is not established and the wild symbol remains within the effective range. In the aspect, when the winning condition is not established and the game chance control device ends the game, even if the effective range of the wild symbol remains, the wild symbol disappears from the predetermined area on the game screen. Therefore, the game machine is in no danger of being in the state such that the probability of the establishment of the winning condition is initially high due to the wild symbol remains at the time point when the player gives a game value to the game machine to start a next game.

The symbol drawing device is adapted and configured to draw symbols from the symbol candidates at any game chance generated in the game, the wild symbol arrangement device may arrange the wild symbol on the predetermined area at a game chance generated at next and subsequent times when the winning condition is established at the game chance at a time point when the symbol drawing device draws the wild symbol. In the aspect, when a requirement is that the wild symbol is drawn at any game chance and then the winning condition is established at the game chance, the wild symbol is arranged on the predetermined area at the next and after game chances. Since the requirement for arranging the wild symbol includes the establishment of the winning condition, the high probability state due to the arrangement of the wild symbol can be generated as one kind of perquisite for the establishment of the winning condition.

The game machine may further comprise a symbol presenting device adapted and configured to present the drawn wild symbol as a symbol to be arranged on the predetermined area at the game chance generated at the next and subsequent times to the player when the symbol drawing device draws the wild symbol. When the drawn wild symbol is presented to the player, a notice can be sent to the player about the state that when the winning condition is established, and the wild symbol is arranged at the next game chance and the high probability state is generated. As a result, player's sense of expectancy can be heightened.

The symbol drawing device may draw a symbol from the symbol candidates at the game chance generated first in the game. In the aspect, since the wild symbol is drawn at the game chance firstly generated, the high probability state can be generated by the common symbol in all games without exception. In the game machine according to the second aspect of the present invention, the symbol candidates may include wild symbols whose effective range varies. When the effective range is varied, the high probability state can be controlled by the wild symbol more flexibly and more suitably.

In order to solve the above problems, a computer program according to the second aspect of the present invention is constituted to allow a computer provided to a game machine to serve as: a game chance control device adapted and configured to generate at least one game chance in a game provided to a player; a symbol arrangement control device adapted and configured to determine types of symbols to be arranged on a predetermined area on a game screen with a predetermined positional relationship according to the generation of the game chance; and a winning determining device adapted and configured to determine whether a predetermined winning condition is established based on the types and the arrangement of the symbols arranged on the predetermined area. The symbol arrangement control device is further adapted and configured to serve as: a symbol drawing device adapted and configured to draw at least one symbol from symbol candidates including normal symbols and wild symbols; a symbol arrangement device adapted and configured to arrange the wild symbol drawn by the symbol drawing device on the predetermined area; a consumption condition determining device adapted and configured to determine whether a predetermined consumption condition is established in the game within the predetermined range; and a symbol control device adapted and configured to control the types and the arrangement of the symbols so that when the wild symbol is arranged on the predetermined area, the effective range is reduced every time that the consumption condition is established, and even if a new game chance is generated, the wild symbol remains on the predetermined area until the effective range is consumed, and when the effective range is consumed, the wild symbol disappears from the predetermined area.

When the computer program of the present invention is executed by the computer provided to the game machine, the game machine of the present invention can be constituted. The computer program of the present invention may be provided to the user with the program being recorded on a recording medium readably by the computer, or may be provided to the user through a wired or wireless communication network.

In order to solve the above problems, a game machine according to a third aspect of the present invention comprises: a drawing chance control device that generates at least one drawing chance in a game within a predetermined range provided to a player in exchange for a game value; a symbol drawing device that draws types of symbols to be arranged on a predetermined area on a game screen with a predetermined positional relationship according to the generation of the drawing chance; a second winning determining device that determines success or failure of a winning condition with formation of a predetermined array on the predetermined area by the same kind of three or more symbols being a prerequisite; and an exception condition determining device that, when symbols other than the symbols establishing the winning condition in the symbols arranged on the predetermined area are used, determines success or failure of an exception condition, in which a prerequisite is partial formation of the predetermined array by the same type of symbols whose number is less than winning necessary number and is two or more, wherein the symbol drawing device comprises an exception processing device that, when the exception condition is established, sets positions where the symbols for establishing the exception condition within the predetermined area are arranged as exception positions, and controls drawing so that the same type of symbols are arranged on the exception positions at the next and after drawing chances.

In the game machine of the present invention, when the drawing chance control device generates a drawing chance, the symbol drawing device draws respectively types of symbols to be arranged on a predetermined area on the game screen with a predetermined relationship. The symbols are arranged on the predetermined area on the game screen according to the drawn result. After the arrangement of the symbols, when the same kind of symbols whose winning necessary number is three or more form a predetermined array, the second winning determining device determines that the winning condition is established. On the other hand, in the case where an attention is paid to symbols which are not involved in the establishment of the winning condition, when the same kind of symbols whose number is less than the winning necessary number and is two or more form a part of the predetermined array, the exception condition determining device determines that an exception condition is established. In other words, a state that the winning condition is about to be established can be defined as the exception condition. When the exception condition is established, the exception processing device sets positions of the symbols establishing the exception condition as the exception positions, and the types of the symbols on the exception positions match with each other at next and after drawing chances. As a result, the winning condition is easily established, and the player's sense of expectancy for the winning is heightened. Since the state that the same kind of two or more symbols are partially included in the predetermined array is passed to the next and after drawing chances, an impression such that the state of almost establishment of the winning condition is set back is not given to the player. Further, the type of symbols on the exception positions is not fixed, and the drawing is controlled so that the same kind of symbols is arranged, and thus the type of symbols appearing on the exception positions can be changed. As a result, the player's sense of expectancy can be sufficiently heightened.

In the present invention, the second winning determining device may determine that the predetermined array is formed when the same kind of symbols whose number is the winning necessary number are adjacent to each other without via another kind of symbols on the predetermined area. Further, the exception condition determining device may determine that the predetermined array is partially formed when symbols other than the symbols for establishing the winning condition are used and the same kind of symbols whose number is less than the winning necessary number and two or more are adjacent to each other without via another kind of symbols.

In the game machine according to the third aspect of the present invention, the drawing chance control device comprises an additional change generating device that generates additional drawing chances as next and after drawing chances in the game within the predetermined range when a predetermined redrawing condition is established in the game within the predetermined range, wherein the exception processing device may control the drawing so that the same type of symbols are arranged on the exception position only at the additional drawing chance. In the aspect, when the redrawing condition is established in the game within the predetermined range provided in exchange for a game value, additional drawing chances are given, and while the additional drawing chances are being repeated, the exception processing device controls the drawing. Therefore, the exception processing device can be operated as a device which can generate a perquisite when the redrawing condition is established and the exception condition is established. The condition that the exception processing device performs control of the drawing can be variously changed by the combination of the redrawing condition and the exception condition.

In the aspect, the additional chance generating device further comprises a redrawing chance frequency drawing device that draws frequency of the additional drawing chances to be generated in the game within the predetermined range by the additional chance generating device, wherein the additional chance generating device may repeatedly generate the additional drawing chance with frequency which is equal to the frequency of the drawing by the redrawing chance frequency drawing device in the game within the same range. In the aspect, when the drawing of the generating frequency of the redrawing chance and the redrawing condition and the exception condition are combined, the expectation value which establishes the winning condition can be varied via the control of the drawing by the exception processing device.

In the aspect, the exception processing device continues the control of the drawing about the exception positions until the symbols arranged on the exception positions establish the winning condition within a range where the additional drawing chances are repeatedly generated, and when the symbols arranged on the exception positions establish the winning condition, the control of the drawing about the exception positions may be ended. In the aspect, the one type of the symbols on the exception positions are continuously appear until the symbols arranged on the exception positions establish the winning condition. As a result, the player's sense of expectation can be further heightened.

In the aspect, the redrawing condition may include the establishment of the winning condition at the drawing chance as a requisite. In the aspect, the redrawing condition is not established unless the winning condition is not established at the drawing chance provided in exchange for the game value. That is to say, the control of the drawing is not started by the exception processing device unless at least the winning condition is established and then the additional drawing chance is generated. Therefore, the exception processing device can be operated as the device which generates a perquisite when the winning condition is established at least once.

In the game machine according to the third aspect of the present invention, the exception processing device may control the drawing so that a symbol to be arranged on any one exception position is drawn and one type of symbols which are the same as the symbol drawn for the one exception position are drawn for the other exception positions unambiguously. In the aspect, when the exception positions are set, the symbol to be arranged on one exception position is drawn, and the drawn result is used as a drawn result for the other exception positions, so that one type of symbols can be arranged on all the exception positions.

In order to solve the above problems, a computer program from a third aspect of the present invention is constituted to allow a computer provided to a game machine to serve as: a drawing chance control device that generates at least one drawing chance in a game within a predetermined range provided to a player in exchange for a game value; a symbol drawing device that draws types of symbols to be arranged on a predetermined area on a game screen with a predetermined positional relationship according to the generation of the drawing chance; a second winning determining device that determines success or failure of a winning condition with formation of a predetermined array on the predetermined area by the same type of three or more symbols being a prerequisite; and an exception condition determining device that, when symbols other than the symbols establishing the winning condition in the symbols arranged on the predetermined area are used, determines success or failure of an exception condition, in which a prerequisite is partial formation of the predetermined array by the same type of symbols whose number is less than winning necessary number and is two or more, and wherein the symbol drawing device to serve further as an exception processing device that, when the exception condition is established, sets positions where the symbols for establishing the exception condition within the predetermined area are arranged as exception positions, and controls drawing so that the same type of symbols are arranged on the exception positions at the next and after drawing chances.

When the computer program of the present invention is executed by the computer provided to the game machine, the game machine of the present invention can be constituted. The computer program of the present invention may be provided to the user with the program being recorded on a recording medium readable by the computer or may be provided to the user through a wired or wireless communication network.

Effect of the Invention

As described above, according to the game machine and the computer program of the present invention, the correspondence relationship between the winning combinations and the dividend values is changed when a dividend change condition is established in such a manner that the column of the dividend values displayed on the dividend list before change shifts to an arrangement direction of the winning combinations. For this reason, the regularity or the order present between the dividend values can be maintained before and after the change on a partial range on the dividend list, and thus the player can be allowed to comparatively easily understand the correspondence relationship after the change. Particularly when a shift amount of the column of the dividend values on the dividend list is predetermined, the correspondence relationship after the change can be estimated before the change. When the dividend change condition is established, the player can be allowed to understand how the dividend value changes more easily. When a change rate or a change amount between the dividend values is finely set, the change in the dividend value before and after the change of the correspondence relationship can be repressed small. As a result, the dividend value can be finely controlled. An effective range is set to common symbols available as two or more types of normal symbols at the determination of the success or failure of the winning condition, and the common symbols are arranged on a predetermined area on the game screen. In this case, while the effective range is being reduced every time when a predetermined consumption condition is established in the game, even if a new game chance is generated, the common symbols are allowed to remain on the predetermined area on the game screen until the effective range is consumed. For this reason, the player's sense of expectance for the winning can be heightened more sufficiently than the case where the common symbols are used only once. On the other hand, the high probability state caused by the common symbols can be controlled flexibly and suitably according to the setting of the consumption condition and the effective range. The state that the winning condition is about to be established is defined as an exception condition in advance, and when the exception condition is established, the positions of the symbols establishing the exception condition are set as exception positions, and the drawing is controlled so that the types of the symbols on the exception positions match with each other at the next and after drawing chances. Therefore, when the exception condition is established, the winning condition is easily established at the next and after drawing chances, so that the player's sense of expectance for the winning is heightened. Since the state that the predetermined array includes the same type of two or more symbols continues at the next and after drawing chances, the impression such that the state of almost establishment of the winning condition is set back is not given to the player. Further, the type of symbols on the exception positions is not fixed, and the drawing is controlled so that one type of symbols appear, so that the type of symbols appearing on the exception positions can be changed. As a result, the player's sense of expectance can be heightened sufficiently.

BRIEF DESCRIPTION OF THE DRAWINGS

FIG. 4 is a diagram illustrating a special symbol drawing table.

FIG. 6 is a diagram illustrating a main slot drawing table.

FIG. 8 is a diagram illustrating a number dividend list.

FIG. 13 is a diagram illustrating a number-of-free games determining table where a number of free symbols is related with a number of free games.

BEST MODE FOR CARRYING OUT THE INVENTION

Figure 1:
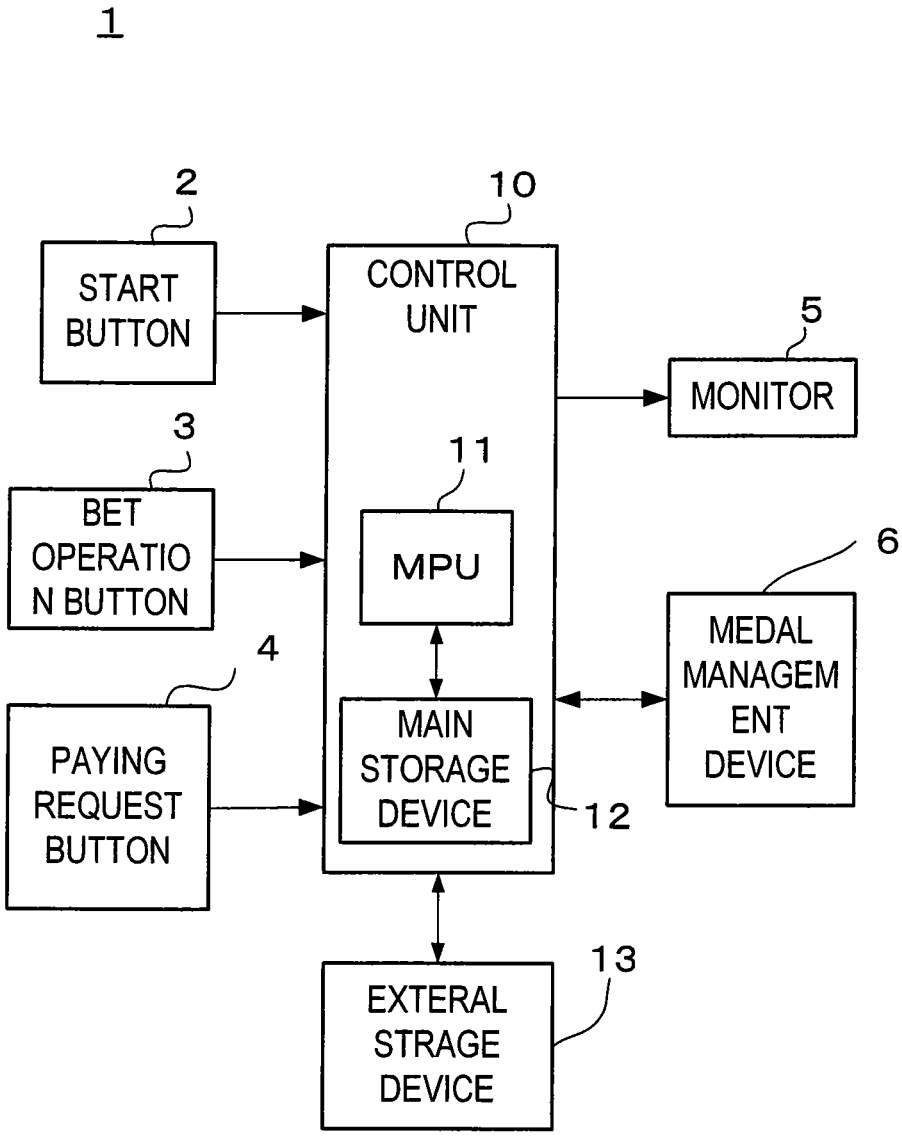
FIG. 1 is a block diagram illustrating a control system of a game machine according to one embodiment of the present invention.

FIG. 1 is a block diagram illustrating a control system of a game machine according to one embodiment of the present invention. A game machine 1 includes a start button 2 as an input device that accepts a player's operation, a bet operation button 3 and a paying request button 4, a monitor 5 that operates as a display device, a medal management device 6 that manages receiving and paying of medals as a game medium, and a control unit 10 that controls a game. The start button 2 outputs a game start signal to the control unit 10 in response to a player's pressing-down operation. The bet operation button 3 outputs a bet signal to the control unit 10 every time when the player presses down this button. The paying request button 4 outputs a medal paying request signal to the control unit 10 in response to the player's pressing-down operation. The monitor 5 displays a game screen according to an image signal output from the control unit 10. The medal management device 6 outputs a medal dropping-in signal to the control unit 10 every time when the player's insertion of a medal is detected, and pays medals to the player in response to the medal paying signal from the control unit 10.

The control unit 10 is constituted as a computer unit in which a microprocessing unit (MPU) 11 and various peripheral devices such as a main storage device 12 composed of ROM or RAM necessary for the operation of the MPU 11 are combined. The control unit 10 is connected to an external storage device 13 such as a magnetic disc storage device. A program and data for controlling the game are saved in the external storage device 13, and the program and the data are suitably loaded into the main storage device 12 from the external storage device 13 according to an instruction from the MPU 11. The MPU 11 executes various calculation processes and operation control according to the program loaded into the main storage device 12 so that the control unit 10 controls game progression. The game machine of this embodiment is constituted as a commercial game machine so that the buttons 2 to 4, the monitor 5, the medal management device 6 and the control unit 10 are mounted to a housing, not shown, and a game within a predetermined range is provided to a player in exchange for a game value represented by a medal.

Figure 2:
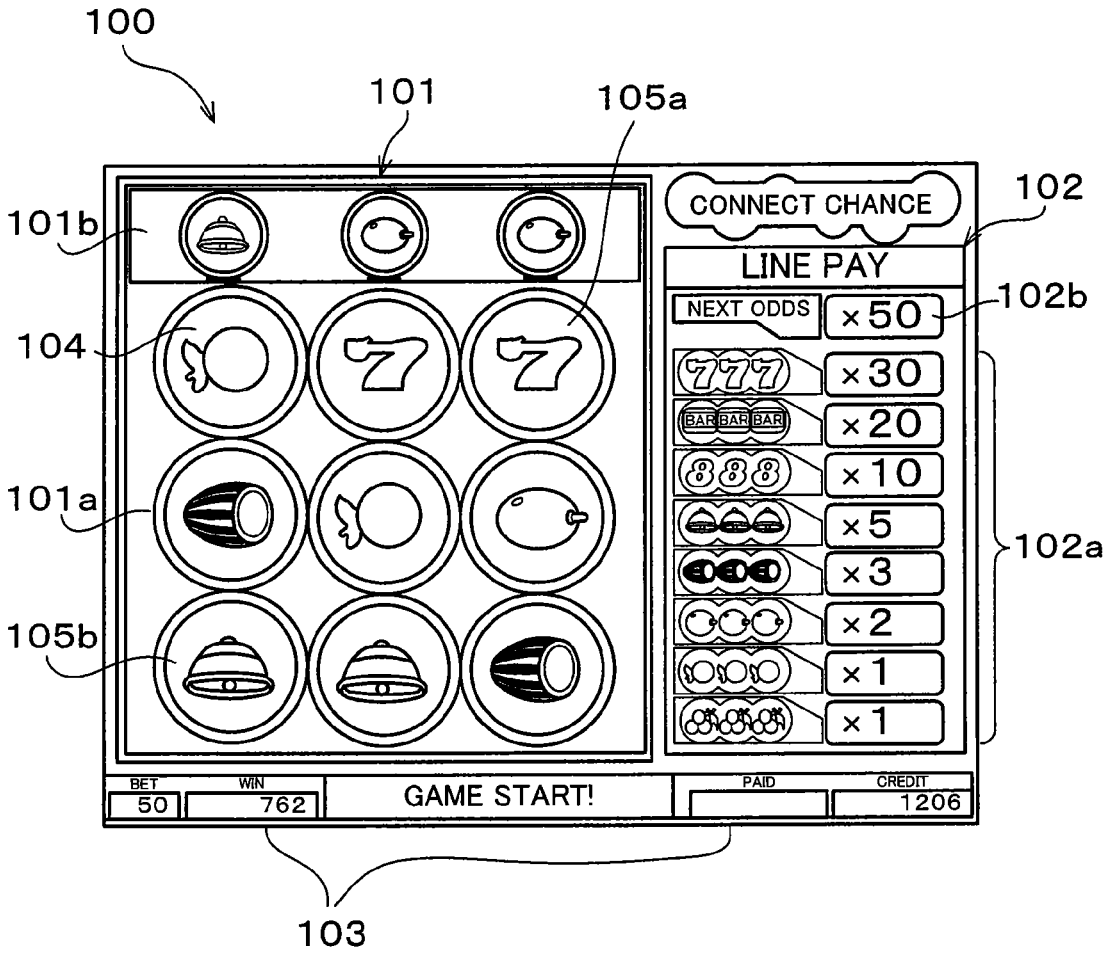
FIG. 2 is a diagram illustrating a basic constitution of a game screen.

FIG. 2 illustrates a basic constitution of a game screen displayed on the monitor 5 based on the control of the control unit 10. A slot display section 101, a line dividend display section 102 and a number-of-medals display section 103 are provided to the game screen 100. The slot display section 101 is provided with a main slot 101*a* as a predetermined area to be determined as to success or failure of a winning condition, and a reserve area 101*b*. The main slot 101*a* is provided with nine frames 104 as symbol display sections, which are arranged into a matrix pattern of 3 rows×3 columns. One symbol selected from types of symbols is displayed on each frame 104. The types of symbols are classified according to visual elements identifiable by the player such as picture, design, number, color and shape. On the game screen 100, like a symbol 105*a* to which a number "7" is given and a symbol 105*b* to which a design "bell" is given, the symbols are displayed with various pictures, designs, numbers and shapes as information for discriminating the types of symbols being given. Eight winning lines composed of three in a vertical direction, three in a lateral direction and two in an oblique direction (diagonal directions on the main slot 101*a*) are set on the main slot 101*a*. The eight winning lines are always set regardless of the number of medals bet by the player. When the same types of symbols are arranged on all the three frames 104 on any winning line, a line winning combination is achieved. That is to say, when the same type of three symbols are adjacent (continue) to each other in one direction without via another types of symbols, the line winning combining is achieved. Three symbols, which move to the main slot 101*a* at the time when a predetermined condition is established, are displayed on the reserve area 101*b* with its column being aligned with three winning lines in the vertical direction.

The line dividend display section 102 is provided with an odds display section 102*a* and a next odds display section 102*b* adjacent upward to the odds display section 102*a*. The odds display section 102*a* functions as a dividend list showing one-to-one correspondence between the line winning combinations and odds (dividend rate) as dividend values. Line winning combinations are displayed on the left side of the odds display section 102*a* with them being arranged in an up-down direction, and odds corresponding to these line winning combinations are displayed on the right side. The arrangement order of the line winning combinations on the odds display section 102*a* is set so that the line winning combinations with lower achievement probability are closer to an upper end of the odds display section 102*a*. The odds on higher positions become essentially higher. The same odds are occasionally set for different winning combinations. In the example of FIG. 2, the same odds "1" is set for the bottom winning combination of "cherry" and the winning combination of "orange" on the second stage from the bottom. When line winning combinations are related with one odds, the probabilities of the achievement of the respective line winning combinations may be equal to each other or may vary.

The correspondence relationship between the odds and the line winning combinations displayed on the odds display section 102*a* is controlled based on odds candidate data D1 (see FIG. 10A) stored in the main storage device 12 of the control unit 10. The correspondence relationship between the line winning combinations and the odds is changed when a predetermined dividend change condition is established in the game. FIG. 2 illustrates the initial correspondence relationship. When the dividend change condition is established, the odds that should be credited to the top stage of the odds display section 102*a* is displayed on the next odds display section 102*b*. In order to discriminate the odds to be displayed on the next odds display section 102*b* from the odds displayed correspondingly to the winning combinations on the odds display section 102*a*, this odds may be called a next odds. Details of display control of the odds and the next odds on the odds display section 102*a* and the next odds display section 102*b* are described later.

A number of bets (BET), a number of winnings (WIN), a number of paying (PAID) and a number of credits (CREDIT) are displayed on the number-of-medals display section 103 from left to right on the game screen 100. The number of bets is the number of medals bet by the player, the number of winnings is the number of medals distributed to the player, the number of paying is number of medals paid to the player, and the number of credits is the number of player's medals kept by the game machine as medals which can be bet on the game. The number of medals to be displayed on the number-of-medals display section 103 is suitably calculated by the MPU 11 of the control unit 10, and then it is stored in the main storage device 12. The MPU 11 increases the number of credits by 1 every time when a medal dropping-in signal is output from the medal management device 6. On the other hand, every time when a bet signal is output from the bed operation button 3, the MPU 11 decreases the number of credits by 1 and the number of bets is increased by 1. When a dividend to the player is generated in the game, the MPU 11 temporarily displays the number of medals to be distributed as the number of winnings, and then adds the number of dividends to the number of credits at a suitable timing. When the number of dividends is added to the number of credits, the dividend is defined. When a medal paying request signal is output from the paying request button 4, the MPU 11 instructs the medal management device 6 to pay medals whose number is the number of credits stored at this time point, and displays the number of credits as the number of paying and simultaneously resets the number of credits stored in the main storage device 12 to 0.

A game process that is executed by the control unit 10 using the calculation function of the MPU 11 is described below. When the number of bets stored in the main storage device 12 of the control unit 10 is one or more and a game starting signal is output from the start button 2, the control unit 10 executes the game process in FIG. 3. From the start to the end of the game process refers to a game within a predetermined range provided in exchange for a game value, and hereinafter this may be referred to as one game.

Figure 14:
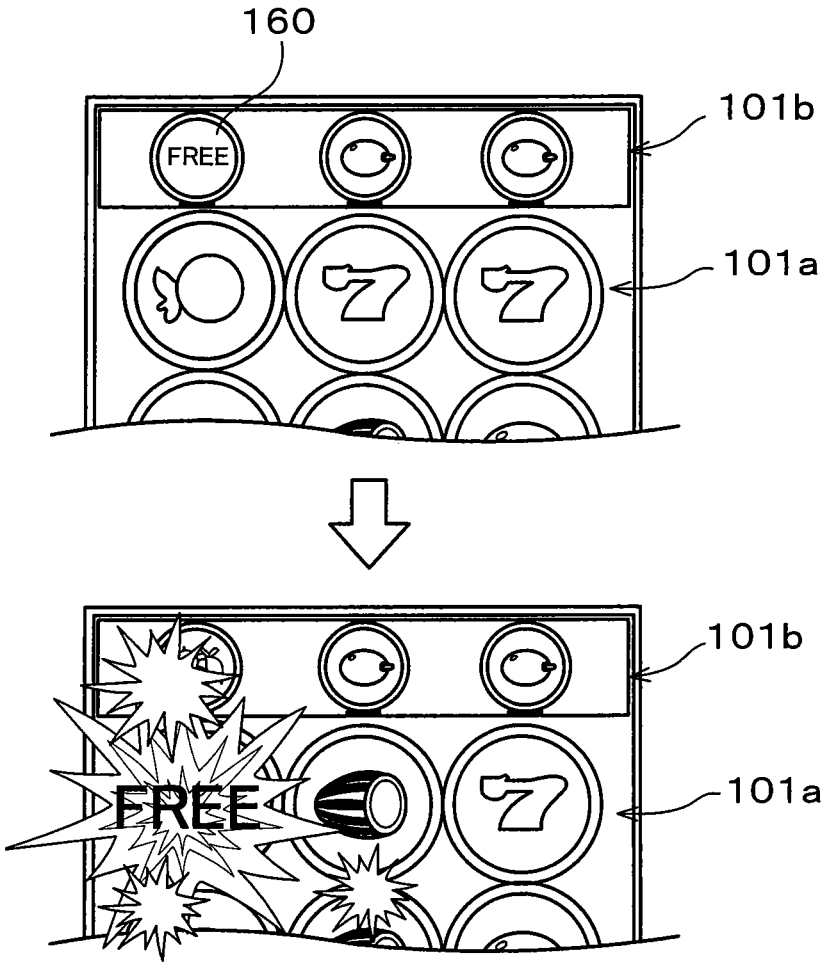
FIG. 14 is a diagram illustrating one example of a screen change when a free game starts.
Figure 17:
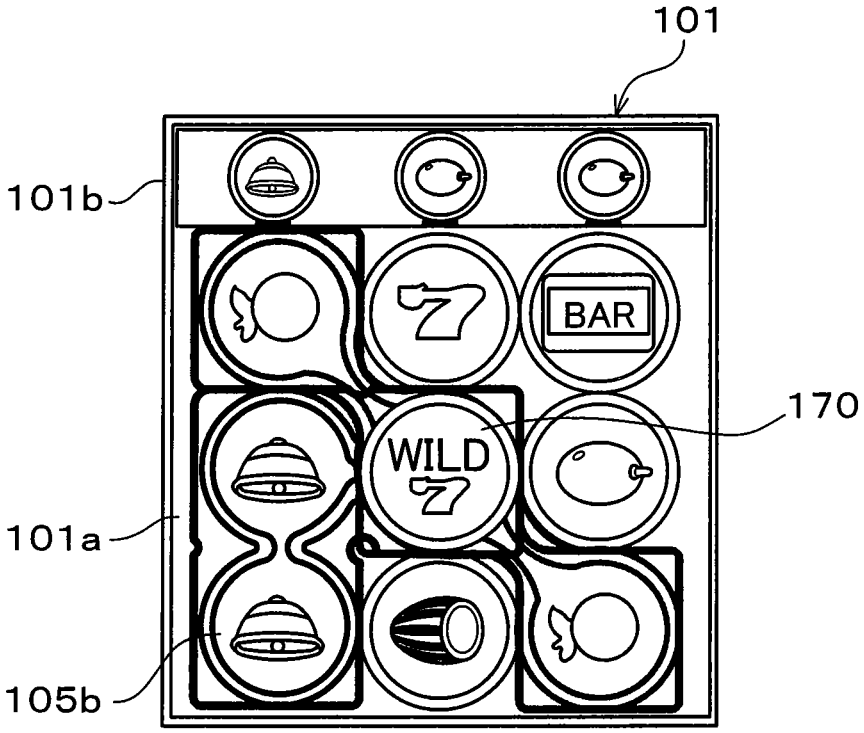
FIG. 17 is a diagram illustrating a state in which the wild symbol shifts to a main slot.

In the game process of FIG. 3, the control unit 10 determines whether a free symbol or a wild symbol is allowed to appear on the reserve area 101*b* at step S1 (hereinafter, this process is called special symbol drawing). The free symbol and the wild symbol are set as special symbols for generating a special game state under a condition that they move from the reserve area 101*b* to the main slot 101*a*. Its details are described later. FIG. 14 illustrates a step in which the free symbol 160 moves from the reserve area 101*b* to the main slot 101*a*, and FIG. 17 illustrates a state in which the wild symbol 170 moves to the main slot 101*a*. In FIG. 17, a number "7" is given to the wild symbol 170; however, this number is displayed as a value representing an effective frequency of the wild symbol 170 on the wild symbol 170. In this specification, the wild symbol to which a number N is given occasionally called a wild N symbol. Whether the special symbol is allowed to appear is drawn only by special symbol drawing, and the special symbol is excluded from target of the other drawing processes. That is to say, the special symbol is not drawn at the time of drawing other than the special symbol drawing.

The special symbol drawing is performed by using a special symbol drawing table TB1 in FIG. 4. In the special symbol drawing table TB1, predetermined certain-digit random numbers are related with special symbols and normal symbols as symbol candidates to be drawing options, and is saved in the external storage device 13 so as to be loaded into the main storage device 12 of the control unit 10. The normal symbols in the table TB1 of FIG. 4 are a general name for all of the symbols appearing on the slot display section 101 other than the special symbols, and thus do not mean symbols other than the specific symbols to which specific pictures or the like are given. Random numbers whose number is in accordance with target appearance probability are allocated to the special symbols and the normal symbols in advance. In other words, because random number generating probabilities are equal to one another, the probability of symbol appearance is determined by the number of the random numbers allocated to the symbols. Since three symbols are displayed on the reserve area 101*b*, a random number is given to a case where an appearance number of free symbols is one, a case of two and a case of three. The larger the appearance number is, the smaller the number of random numbers is set. Therefore, the larger the appearance number of free symbols is, the lower the probability is. On the other hand, only one wild symbol appears in the reserve area 101*b*. However, the number of random numbers to be allocated to the wild symbols are varied so that the larger the numerical value (N=3, 5, 10, . . . ) is, the lower the appearance probability becomes.

In the special symbol drawing at step S1, any of the random numbers written into the special symbol drawing table TB1 is drawn, the symbol related with the selected random number is specified from the special symbol drawing table TB1, and then the specified symbol is determined as an appearance symbol. When the free symbol or the wild symbol is drawn, a position where a special symbol should be allowed to appear on the reserve area 101*b* is determined by a suitable method. When three free symbols are allowed to appear, the position does not have to be determined.

Figure 3:
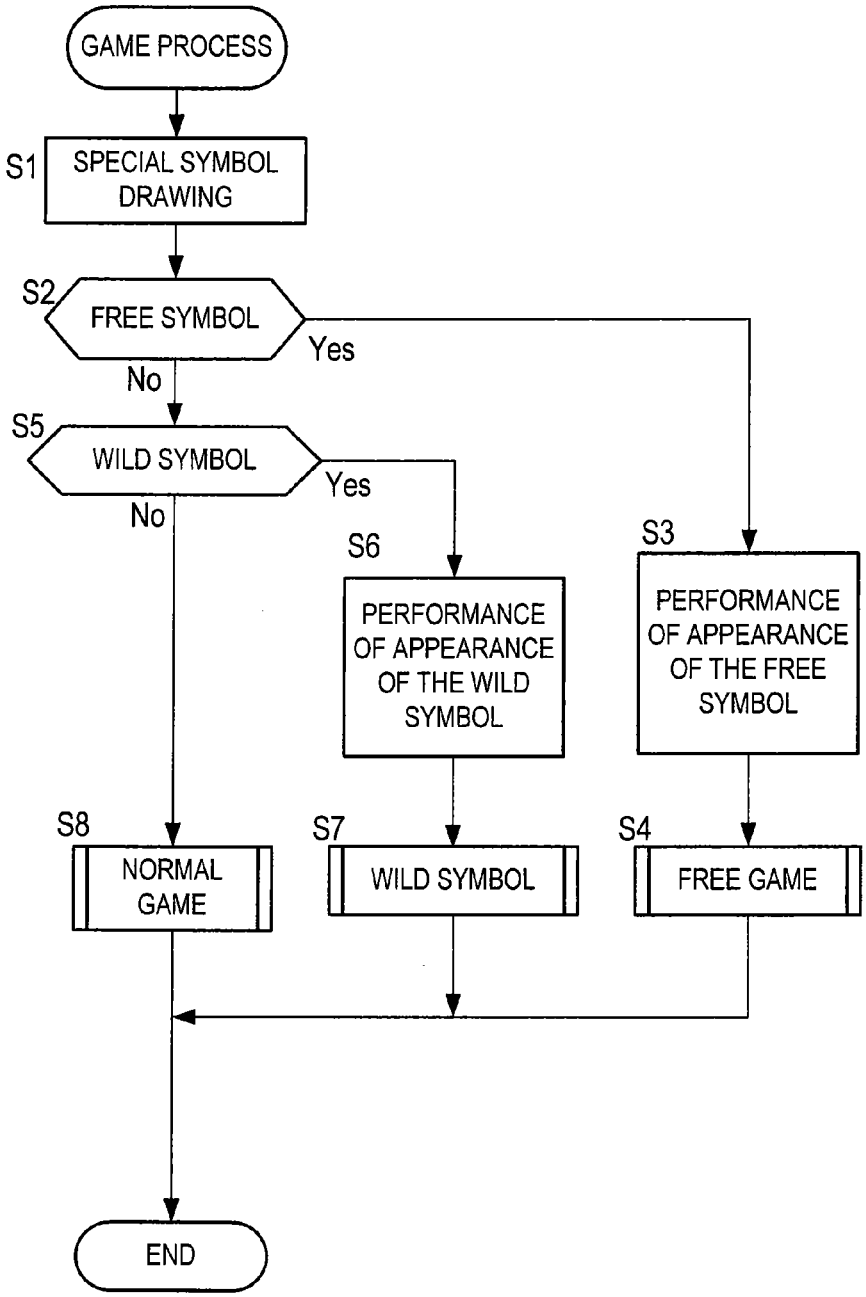
FIG. 3 is a flow chart illustrating a game process.

The description continues with reference to FIG. 3. When the special symbol drawing is completed, the control unit 10 goes to next step S2, and a determination is made whether the symbol selected by the special symbol drawing is a free symbol. When the selected symbol is the free symbol, the control unit 10 goes to step S3, and a performance at the time of the appearance of the free symbol is started. For example, the performance is performed in such a manner that animation for sequentially replacing various symbols is displayed on the position where the special symbol should be allowed to appear on the reserve area 101*b*, and finally the animation is ended with the free symbol appearing. After the starting of the performance, the control unit 10 goes to step S4, and a free game process (FIG. 12) as a subroutine process is executed in response to the appearance of the free symbol. The control unit 10 waits for the end of the subroutine process at step S4, and then ends this game process.

When the determination is made at step S2 that the symbol is not the free symbol, the control unit 10 goes to step S5, and determines whether the selected symbol is a wild symbol. When the selected symbol is the wild symbol, the control unit 10 goes to step S6, and then starts a performance for allowing the wild symbol to appear. The performance may be carried out similarly to step S3. After the start of the performance, the control unit 10 goes to step S7, and executes a wild symbol process (FIG. 16) as a subroutine process in response to the appearance of the wild symbol. The control unit 10 waits for the end of the subroutine process at step S7, and then ends this game process.

When the symbol is not determined as a wild symbol at step S5, the control unit 10 goes to step S8, and executes a normal game process (FIG. 5) as a subroutine process corresponding to the case when the normal symbol is selected. When the control unit 10 goes to the normal game process, only normal symbols are displayed on the reserve area 101*b*. In this case, when only normal symbols appear on the reserve area 101*b* at the time of the end of the previous game, the display of these symbols may continue. When the previous game is ended with a special symbol appearing on the reserve area 101*b*, any normal symbol is allowed to appear instead of the special symbol. In another manner, three symbols to be allowed to appear on the reserve area 101*b* are drawn from the normal symbols regardless of the state of the reserve area 101*b* at the time of the end of the previous game, and the selected symbol may be allowed to appear. When the drawing of a normal symbol is necessary, the drawing may be performed by using a random number similarly to the special symbol drawing. When the control unit 10 goes to step S8, the control unit 10 waits for the end of the normal game process, and ends this game process. When three symbols to be allowed to appear on the reserve area 101*b* are determined at the game process in FIG. 3, the control unit 10 writes reserve area data for specifying an arrangement of symbols on the reserve area 101*b* into the main storage device 12.

The normal game process is described below with reference to FIG. 5. In the normal game process, the control unit 10 draws symbols to be allowed to appear on the nine frames 104 (see FIG. 2) of the main slot 101*a* at step S11 (hereinafter, this process is called main slot drawing). The main slot drawing is performed with reference to a main slot drawing table TB2 shown in FIG. 6 as one example. In the main slot drawing table TB2, symbols generally called normal symbols are related with predetermined-digit random numbers, and this table is saved in the external storage device 13 in advance and is loaded into the main storage device 12. In the main slot drawing table TB2, the number of random numbers to be allocated to the symbols is adjusted according to appearance probability of the symbols. When it is assumed that an arrangement order of line winning combinations on the odds display section 102*a* in FIG. 2 is set according to achievement probability of the line winning combinations, the probability with which the symbol "7" (which composes the line winning combination "777", whose achievement probability is the lowest) appears is the lowest, and the number of random numbers allocated to this is set to a minimum value. A larger number of random numbers are allocated to the symbol "bell" composing the line winning combination "bell", whose achievement probability is higher than "777".

In the main slot drawing at step S11, some of the random numbers in the main slot drawing table TB2 are drawn for the nine frames 104 of the main slot 101*a*. Thereafter, symbols related with the selected random numbers are specified from the main slot drawing table TB2, and these symbols are determined as symbols to be allowed to appear on the frames 104. The drawing for each of the frames 104 is respectively performed independently at step S11. The drawn result for any one of the frames 104 does not influence the drawing for the other frames 104. When the symbols of the frames 104 are determined, the control unit 10 allows the selected symbols to appear on the main slot 101*a* with predetermined performance being given. For example, the performance may use a suitable method such as display of animation for sequentially replacing symbols on the frames 104. Further, the control unit 10 writes symbol arrangement data for specifying an arrangement of the symbols on the main slot 101*a*, namely, which symbol is displayed on each of the frames 104 in the main storage device 12.

Figure 7:
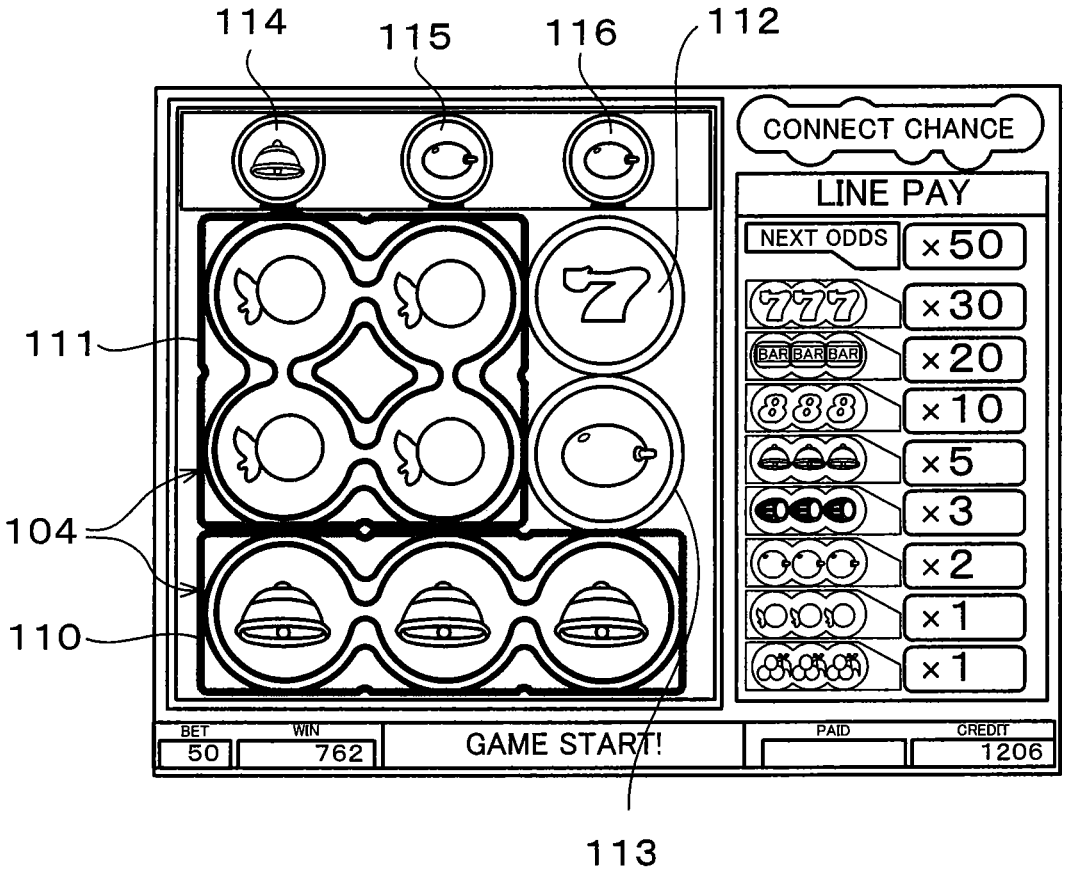
FIG. 7 is a diagram illustrating one example of the game screen when a winning combination is achieved.

At next step S12, the control unit 10 checks the symbol arrangement data and determines whether a winning combination is achieved on the main slot 101*a*. In other words, a winning condition is established. In this case, the winning combination to be determined includes winning combinations other than the above-mentioned winning combinations. FIG. 7 illustrates an example that a connect bonus winning combination 111 is achieved as another winning combination besides the line winning combination 110. The connect bonus winning combination 111 is achieved when the same type of three or more symbols continue in arrangements other than the winning line. That is to say, when a symbol on one frame is considered, the connect bonus winning combination is achieved when the same type of one symbol is arranged in each of an up-down direction and a right-left direction based on the symbol. Some of the symbols forming the connect bonus winning combination 111 may be included in the line winning combination 110. When at least one of the line winning combination and the connect bonus winning combination is achieved, the winning combination is determined as being achieved at step S12 of FIG. 5. When the winning combination is not achieved at step S12, the control unit 10 ends the normal game process, and returns to the game process in FIG. 3.

Figure 5:
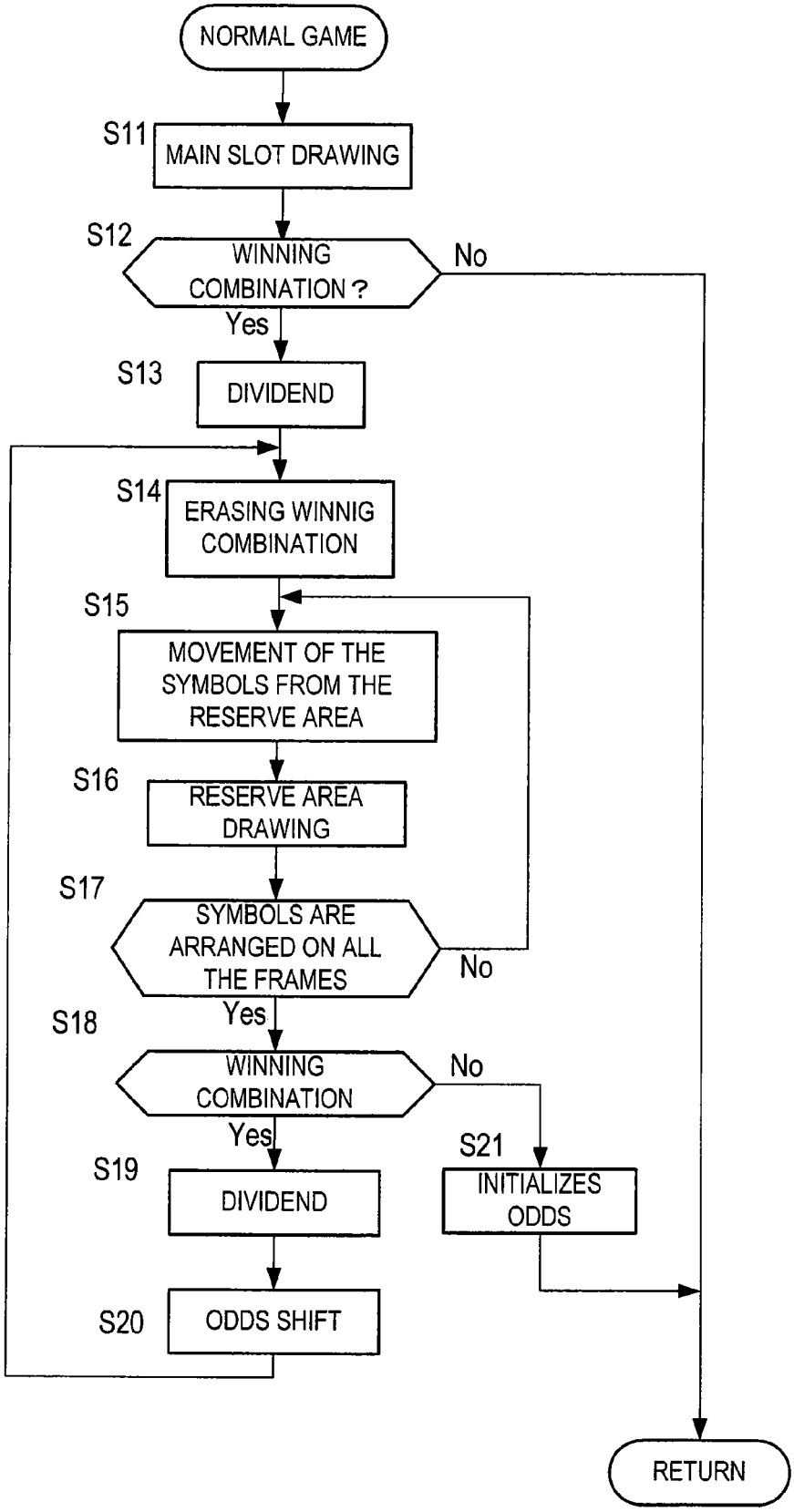
FIG. 5 is a flow chart illustrating a normal game process.

When the winning combination is achieved at step S12 in FIG. 5, the control unit 10 goes to next step S13, and gives a dividend corresponding to the achieved winning combination to the player. When the line winning combination is achieved, a number of medals (determined by multiplying the number of bets by odds related with the achieved line winning combination) are given as a dividend. The correspondence relationship between the line winning combinations and the odds is as displayed on the odds display section 102*a* in FIG. 2 at the time of the establishment of the winning combination. For example, when the line winning combination 110 is formed by the symbols "bell" as shown in FIG. 7, since the odds of "bell" on the odds display section 102*a* in FIG. 2 is 5, the number of medals given as a dividend is determined by quintupling the number of bets.

When the connect bonus winning combination is achieved at step S12, the number of medals whose given as a dividend is determined by multiplying the number of bets by odds related with the established connect bonus winning combination. For example, the correspondence relationship between the connect bonus winning combinations and the odds is set as shown in a number dividend table 120 in FIG. 8. The number dividend table 120 is constituted as a table where symbols are arranged in a row direction (lateral direction) and the number of symbols forming the connect bonus winning combination is arranged in a column direction (vertical direction). Odds on places related with symbols forming the connect bonus winning combination and the number of the arranged symbols are odds related with the connect bonus winning combination. A data table, in which the correspondence relationship on the number dividend table 120 of FIG. 8 is described, is saved in the external storage device 13 in advance, and the data table is also loaded into the main storage device 12 at an appropriate time. The control unit 10 (and more specifically, the MPU 11) specifies odds related with the connect bonus winning combination with reference to the data table, and calculates a dividend to the player. In the example of FIG. 7, since the connect bonus winning combination 111 is achieved by four symbols to which the picture "orange" is given, "1" is specified as odds related with the symbol "orange" and the number "4", and medals whose number is the same as the number of bets are given as dividend. When the line winning combination and the connect bonus winning combination are simultaneously achieved, a total value of the dividends related with the respective winning combinations is given as divided. The dividend to the player is realized by the control unit 10 by adding the number of medals calculated at step S13 to the number of hits.

After the dividend is given at step S13 in FIG. 5, the control unit 10 proceeds next to step S14, and updates the symbol arrangement data in the main storage device 12 so that the symbols forming the winning combination are erased from the main slot 101*a*, and the symbols of the above-adjacent frames 104 move to the frames 104, which are blank due to the erasure. According to the updating of the symbol arrangement data, the control unit 10 erases symbols on the main slot 101*a* or displays a state of moving. In the example of FIG. 7, the symbol arrangement of the main slot 101*a* is changed so that the symbols "bell" and "orange" are erased, and the symbol 112 "7" and the symbol 113 "plum" are move down on the main slot 101*a* by one row.

When the symbols are erased and moved as described above, the blank frames 104 remain on the main slot 101*a*. In order to fill the blanks, the control unit 10 updates the symbol arrangement data so that symbols displayed on the reserve area 101*b* move to the blank frames 104 at step S15, and displays the movement of the symbols from the reserve area 101*b* to the main slot 101*a*. For example, in FIG. 7, the frames 104 on the first and second columns from the left become blanks. On the first column, the symbol 114 "bell" moves from the reserve area 101*b* to the frame 104 on the third row (the bottom stage), and similarly on the second column, the symbol 115 "plum" moves to the frame 104 on the third row. On the third column, the symbol "plum" 116 moves from the reserve area 101*b* to blank frame 104 on the first row. According to the movement of the symbols from the reserve area 101*b* to the main slot 101*a*, the reserve area data is also updated.

When the symbols move from the reserve area 101*b* to the main slot 101*a*, a blank is generated on the reserve area 101*b*. Therefore, the control unit 10 draws a symbol to be displayed on a blank portion of the reserve area 101*b* at next step S16 (hereinafter, reserve area drawing). The reserve area drawing may be performed by using random numbers similarly to the main slot drawing. In the reserve area drawing, only normal symbols are to be drawn, and special symbols are excluded from the drawing. That is to say, special symbols are not drawn in the reserve area drawing. During the reserve area drawing, the reserve area data is also updated.

The control unit 10 determines whether symbols are arranged on all the frames 104 of the main slot 101*a* based on the symbol arrangement data at next step S17. That is to say, the determination is made whether the blank frame 104 disappears based on the movement of the symbols from the reserve area 101*b*. When the frame 104 where symbol is not arranged remains, the control unit 10 repeats the processes at steps S15 to S17 until all the bank frames 104 are filled with symbols. With the repetition, symbols sequentially move from the reserve area 101*b* to the main slot 101*a*, and new symbols are credited to the reserve area 101*b*. The symbol arrangement data and the reserve area data are updated into contents corresponding to the symbol arrangement after the movement.

When the determination is made at step S17 that the symbols are arranged on all the frames 104, the control unit 10 goes to step S18. That is to say, symbols do not move on the slot display section 101, and after the symbols on both the main slot 101*a* and the reserve area 101*b* are defined, the control unit 10 goes to step S18. At step S18, the control unit 10 determines whether a winning combination is achieved on the main slot 101*a* by checking the symbol arrangement data. This process is for determining whether the line winning combination and the connect bonus winning combination are achieved similarly to the process at step S13. The process at step S18, however, is different from the process at S12 in that a subject to be determined is the main slot 101*a* where symbols are rearranged by the processes at steps S14 to S17.

Figure 9:
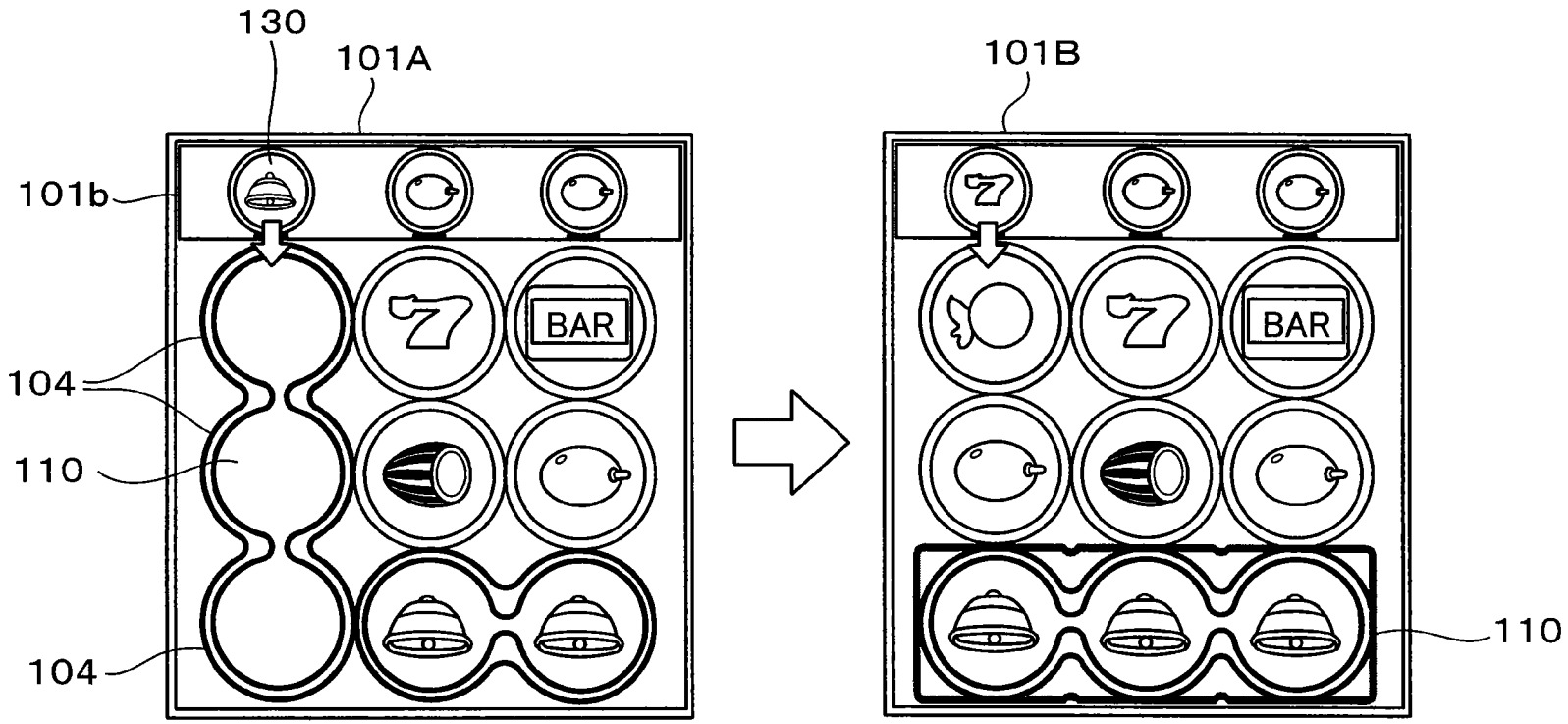
FIG. 9 is a diagram illustrating a state in which symbols are rearranged due to the establishment of a winning combination.

FIG. 9 illustrates an example that a new winning combination is achieved by the rearrangement of symbols. The slot display section 101A on the left side of FIG. 9 illustrates a state at the time when the winning combination is erased at step S14, and the slot display section 101B on the right side of FIG. 9 illustrates a case when the step S17 is affirmative, namely, they illustrates a state at the time when the rearrangement of symbols is completed. On the slot display section 101A of FIG. 9, three frames 104 on the column on the left side are blank. In this case, the symbol "bell" 130 arranged on the left end of the reserve area 101*b* moves to the frame 104 on the bottom stage. Further, symbols are sequentially arranged on frames 104 on the second and first rows by the reserve area drawing at step S16. On the slot display section 101B of FIG. 9, the symbol "plum" is arranged on the second row, and the symbol "orange" is arranged on the first row. On the slot display section 101B after the rearrangement of symbols, the line winning combination 110B of "bell" is achieved on the third row. At step S18, the determination of whether the winning combination is achieved after the foregoing rearrangement of symbols is made.

When the winning combination is achieved at step S18, the control unit 10 goes to step S19 and a dividend according to the established winning combination is given to the player. This process may be similar to the process at step S13. At step S20, the control unit 10 changes the correspondence relationship between the line winning combinations and the odds so that the column of odds displayed on the odds display section 102*a* shifts to below-adjacent stage. That is to say, the control unit 10 regards the dividend change condition as being established when the winning combination is achieved after the rearrangement of symbols, and changes the correspondence relationship between the line winning combinations and the odds. One example of a method for controlling the correspondence relationship is described below.

Figures 10A, 10B:
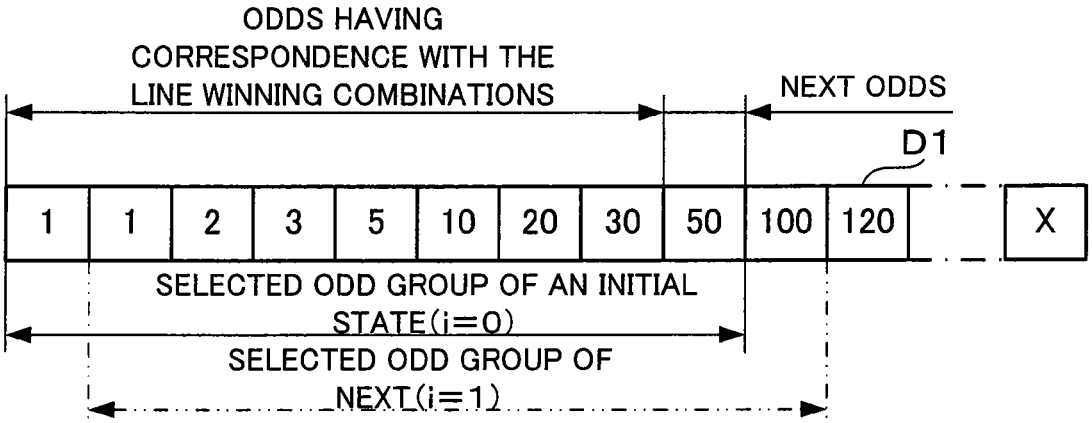
FIG. 10A is a diagram illustrating odds candidate data and selected odds group set by the data.
FIG. 10B is a diagram illustrating one example of a dividend table generated based on the odds candidate data.

Odds candidate data D1 shown in FIG. 10A, which is one kind of data to be seen at the time of control of the correspondence relationship between the line winning combinations and the odds, is stored as dividend candidate data in the external storage device 13 in advance. The odds candidate data D1 has a data structure where a predetermined number of odds candidate values (corresponding to dividend candidate values) are arranged in predetermined order. The number of odds candidate values is sufficiently larger than the number of line winning combinations to be displayed on the odds display section 102*a*. The arrangement order of the odds candidate values is set so that in principle, the odds candidate values become larger towards the tail end from the head (the left end in FIG. 10A) of the odds candidate data D1. In some cases, however, one kind of values continues. In the example of FIG. 10A, both the head and the next odds candidate value are set to 1. In the odds control, the control unit 10 selects a series of odds candidate values whose number is larger by one than the number of line winning combinations as a selected odds group (corresponding to selected divided value group) for the odds candidate data D1. A series of odds candidate values from the head of the selected odds group towards the tail end whose number is the same as the winning combinations is selected as odds having one-to-one correspondence with the line winning combinations, and an odds candidate value positioned on the tail end of the selected odds group is selected as next odds.

The correspondence relationship between the odds candidate values included in the selected odds group and the line winning combinations is determined so that the arrangement order of the line winning combinations with the bottom stage of the odds display section 102*a* being the head matches with the arrangement order of the odds candidate values in the odds candidate data D1. As a result, higher odds are set to the line winning combinations whose establishment probability is lower. For example, the odds candidate value at the head of the selected odds group becomes odds related with the line winning combination of "cherry" displayed on the bottom stage on the odds display section 102*a*, and the second odds candidate value from the head becomes odds related with the line winning combination of "orange". The second odds candidate value from the tail end of the selected odds group becomes odds related with the line winning combination of "7". Odds related with the line winning combinations are displayed on the odds display section 102*a* according to the correspondence relationship. A next odds, namely, the odds candidate value at the tail end of the selected odds group is displayed on the next odds display section 102*b*.

The correspondence relationship between the line winning combinations and the odds is changed whenever the dividend change condition occurs by shifting a range of the selected odds group set on the odds candidate data D1 in a direction where the odds become higher by one odds candidate value. As a result, the expectance value of the dividend becomes higher whenever the dividend change condition is established. The expectance value is a total sum of products of the establishment probability of the line winning combinations and the odds, and represents the number of dividends of medals that can be expected by the player when one medal is bet.

One method for changing the range of the selected odds group is described below. In an initial state, the dividend change condition was not established after the normal game process in FIG. 5 and a variable i, which is used for determining the number of establishment times of the dividend change condition after the initial state, is saved in the main storage device 12. In the initial state, the variable i is 0, and the variable i is increased by 1 every time the dividend change condition is established. The setting range of the selected odds group in the odds candidate data D1 is changed so that the i-th odds candidate value from the odds candidate data D1 becomes the head value of the selected odds group. According to this method, in the initial state (i=0), as shown in FIG. 10A, the odds candidate values whose number is larger than the number of line winning combinations by one are selected as the selected odds group from the head of the odds candidate data D1. When the dividend change condition is once established, the variable i becomes 1, and the range of the selected odds group shifts, namely, moves by one odds candidate value from the head of the odds candidate data D1 towards the tail end. In similar manner, every time the dividend change condition is established, the range of the selected odds group shifts one by one. That is to say, the range of the selected odds group can be determined with the variable i being used as an amount of a shift of the selected odds group from the head of the odds candidate data D1. Since the odds candidate value at the tail end of the odds candidate data D1 is displayed only on the next odds display section 102*b*, dummy data may be used.

The dummy data may be a character string representing that the shift of odds reaches an upper limit.

Figure 11:
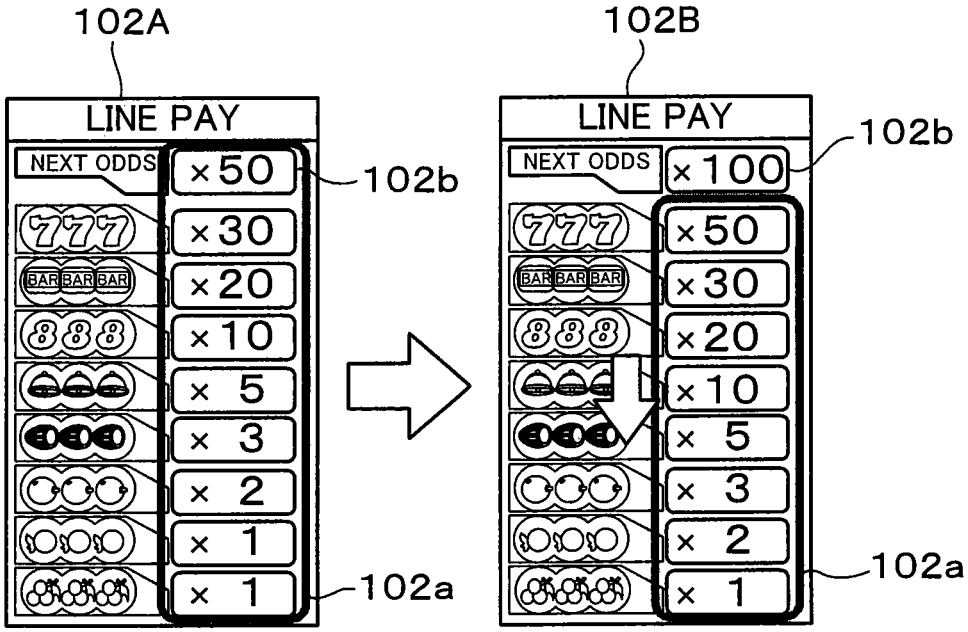
FIG. 11 is a diagram illustrating a state in which a column of odds shifts downward on an odds display section.

As described above, the setting range of the selected odds group is shifted, so that the odds moves (shifts) downward step by step on the odds display section 102*a* every time when the dividend change condition is established. A next odds displayed on the next odds display section 102*b* is credited as new odds to the blank generated on the top stage of the odds display section 102*a* due to the movement, namely, a field of odds which should be related with the line winning combination "777". Further, an odds candidate value newly taken into the selected odds group is displayed as new next odds on the next odds display section 102*b*. FIG. 11 illustrates one example of display change on the line divided display section 102. The line divided display section 102A shown on the left side of FIG. 11 includes the odds display section 102*a* and the next odds display section 102*b* in the initial state. When the divided change condition is established in this state, the column of the odds shift downward one by one like the line divided display section 102B shown on the right side of FIG. 11, and the next odds "50" displayed on the next odds display section 102*b* moves to odds of the line winning combination "7" on the top stage of the odds display section 102*a*. "100" is displayed as new next odds on the next odds display section 102*b*. When the range of the selected odds group reaches the odds candidate value at the tail end of the odds candidate data D1, the variable i is returned to the initial value "0".

When dividends for the achievement of the line winning combinations are calculated, the odds candidate data D1 and the variable i function also as data for specifying odds related with the achieved line winning combinations. That is to say, when any one of line winning combination is achieved, a sum obtained by adding the variable i to order starting from the bottom stage on the odds display section 102*a* for the achieved winning combination is obtained as a determination value j representing a position of related odds on the odds candidate data D1, and a j-th odds candidate value from the head of the odds candidate data D1 may be specified as odds related with the achieved line winning combination. As one example, a case where the line winning combination "orange" is achieved with the divided change condition is once established in the initial state (i=1) is considered. Since the order of the line winning combination "orange" on the odds display section 102*a* is 2, the determination value j becomes 3, and the third odds candidate value "2" from the head of the odds candidate data D1 is specified as odds related with the line winning combination "orange" at this time point. The specified odds "2" is multiplied by the number of medal bets, and thereby the dividend can be obtained. The odds candidate data D1 and the variable i function as divided data for defining the correspondence relationship between the line winning combinations and the dividends.

For example, after the range of the selected odds group is specified by using the odds candidate data D1 and the variable i, as shown in FIG. 10B, a dividend table TB3 in which the line winning combinations and the odds are described in a related manner is created, and is saved in the main storage device 12. Also, the display on the odds display section 102*a* may be controlled and the odds at the time of calculating dividends may be specified with reference to the dividend table TB3. In this case, the table TB3 functions as divided data. In the example of FIG. 10B, next odds and an odds candidate value related with this odds are also described into the dividend table TB3, and the display on the next odds display section 102*b* can be controlled with reference to the table TB3. However, the value of the next odds may be saved as data separated from the table TB3 in the main storage device 12.

The description about the normal game process is continued with reference to FIG. 5. After the odds are shifted at step S20, the control unit 10 returns to step S14, and then executes the processes at steps S14 to S18 again. When the winning combination is achieved again at step S18, the dividend change condition is established again, and dividend is added at step S19, and the correspondence relationship between the line winning combinations and the odds is changed at step S20, and then the process returns to step S14. Due to this repetition, the odds displayed on the odds display section 102*a* are sequentially shifted down, and the player's expectance value for dividends is comparatively heightened. When the winning combination is not achieved at step S18, the control unit 10 goes to step S21, and initializes the odds displayed on the odds display section 102*a*, namely, resets the correspondence relationship between line winning combinations and the odds to the initial state. In other words, when a winning combination is not achieved even if symbols forming the winning combination are erased and accordingly symbols are rearranged, the shift of odds is ended, and the odds are returned to the initial state. After the initialization at step S21, the control unit 10 ends the normal game process and then returns to the game process in FIG. 3.

In the normal game process described above, when a winning combination is achieved in the main slot drawing at step S11, the processes at steps S14 to S17 are executed, and thereby the symbols forming the winning combination is erased, and symbols move down from above so as to fill the blank frames 104 generated by the erasing, and a new symbol is credited from the reserve area 101*b* to the blank frame 104 remaining after the movement, and nine symbols are rearranged on the main slot 101*a*. When a winning combination is achieved due to the rearrangement, the divided change condition is established, and the column of an odds on the odds display section 102*a* shifts down by each stage, and the odds displayed on the bottom stage of the odds display section 102*a* is erased so that a next odds displayed on the next odds display section 102*a* is credited as the new odds to the blank generated on the top stage of the odds display section 102*a*. The new odds candidate value taken into the selected new odds group is displayed as next odds on the next odds display section 102*b*. Even when the column of odds shifts by one stage, regularity or order of odds change set between odds before the shift is directly maintained between odds from the bottom stage to a stage previous to the top stage on the odds display section 102*a*. Therefore, the player can be allowed to easily understand how the odds change. Further, since the odds credited to the top stage of the odds display section 102*a* is displayed on the next odds display section 102*b* before the shift in advance, the player can be allowed to easily understand the odds that are set for the line winning combination "777", whose probability is the lowest at next shift. For this reason, needless confusion caused by the change in odds can be avoided.

Because the expectance value for the dividend rises when odds shift, the change in odds can sufficiently attract player's interests. Because the odds for respective line winning combinations are changed to higher values by shifting odds step by step, the odds can be controlled more finely than the case where odds are simply integral-multiplied. In the example of FIG. 2, when odds are doubled uniformly, the odds set for the line winning combination "777" with large number of dividends increases from "30" to "60"; however in the present embodiment, the odds increase only from "30" to "50", so that a sudden increase in odds can be avoided. On the other hand, the odds for the line winning combination "orange" is increased from "1" to "2", so that the number of dividends to a winning combination with high probability can be sufficiently increased. That is to say, a change amount or a change rate between odds is graduated finely, and thereby the change in odds before and after the shift can be controlled finely.

Figure 12:
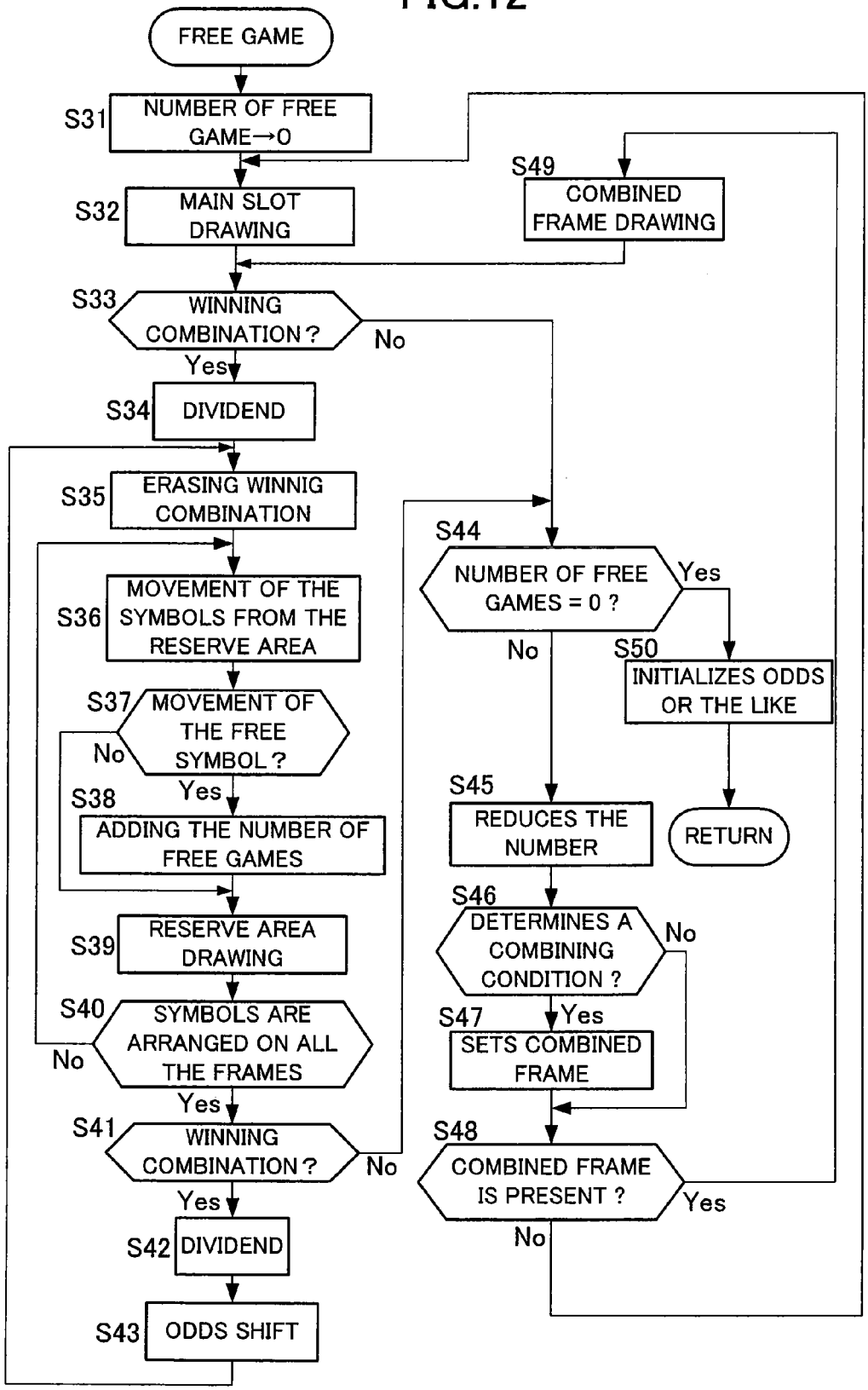
FIG. 12 is a flow chart illustrating a free game process.

A free game process is described below with reference to FIG. 12. The free game process in FIG. 12 corresponds to the subroutine process to be executed at step S4 in FIG. 3. That is to say, when at least one free symbol appears on the reserve area 101*b* as a result of the special symbol drawing, the free game process in FIG. 12 is executed. In the free game process, the control unit 10 sets the number of free games saved in the main storage device 12 to an initial value 0 at step S31. Processes at steps S32 to S36 are similar to the processes at steps S11 to S15 in the normal game process in FIG. 5, and description thereof is omitted. However, at step S35, an additional process (described below) is occasionally performed After the process for moving a symbol from the reserve area 101*b* to the main slot 101*a* is executed at step S36, the control unit 10 goes to step S37, and determines whether a free symbol moves from the reserve area 101*b* to the main slot 101*a*. The determination can be made whether a free symbol moves by seeing the symbol arrangement data updated according to the movement of the symbol or the reserve area data just before the movement.

When the determination is made that the free symbol moves at step S37, the control unit 10 goes to step S38, and adds the number of times according to the number of free symbols moved to the main slot 101*a* to the number of free games saved in the main storage device 12. The number of the moved free symbols can be specified by seeing the updated symbol arrangement data or the reserve area data just before the movement of the symbol. The correspondence relationship between the number of moved free symbols and the number of free games can be specified by preparing a determination table TB4 shown in FIG. 13 in the external storage device 13 and loading it into the main storage device 12 and seeing it through the control unit 10. The number of free symbols moved from the reserve area 101*b* to the main slot 101*a* is related with the number of free games to be added according to the movement and they are described into the table TB4 in FIG. 13.

When the determination is made as yes at step S37 and the number of free games is added at step S38, a free game is started as one of special game states. When the free game is started, various processes according to the main slot drawing and the result of the drawing are repeated even if the player does not bet new medals until the number of free games saved in the main storage device 12 becomes 0. When the free game is started, on the game screen 100, as shown in FIG. 14, the free symbol 160 present on the reserve area 101*b* of the slot display section 101 moves to the main slot 101*a*, and characters "FREE" are enhanced, and thereby the starting of the free game is enhanced. The free symbol moved to the main slot 101*a* is changed into any one of normal symbols by the process in the control unit 10. In this change, drawing using random numbers can be used.

After the number of free games is added, the control unit 10 goes to step S39. When the free symbol does not move at step S37, the control unit 10 skips step S38 to step S39. Steps S39 to S42 are similar to steps S16 to S19 in the normal game process of FIG. 5, and the description thereof is omitted. A process at step S43 is similar to step S20 in FIG. 5 in that the correspondence relationship between the line winning combinations and the odds is changed and the odds on the odds display section 102*a* are shifted. However, at step S43, when the range of the selected odds group shown in FIG. 10A reaches an odds candidate value at tail end of the odds candidate data D1, the variable i is forbidden from being reset to initial value 0, and the variable i is maintained at a maximum value. That is to say, when the odds related with the line winning combination reaches the maximum value in the free game, the reset of odds to the initial state is forbidden. When the winning combination is not achieved at step S41, the control unit 10 goes to step S44, and determines whether the number of free games saved in the main storage device 12 is 0. Also when the winning combination is not achieved at step S33, the control unit 10 goes to step S44. When this free game is the final game or the free game is not started, the number of free games becomes 0. When the number of free games is 1 or more, the control unit 10 reduces the number of free games by 1 at step S45, and then goes to step S46.

Figure 15:
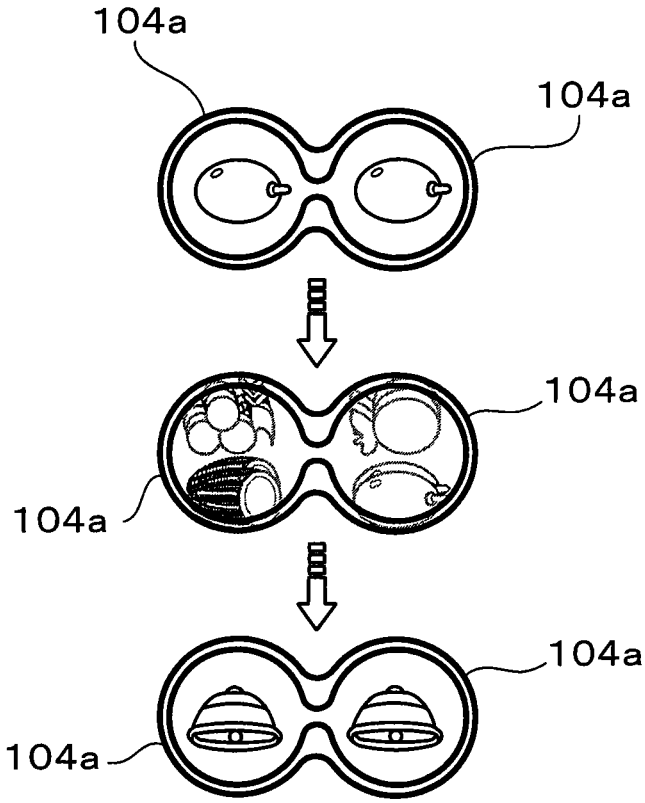
FIG. 15 is a diagram illustrating one example of a change in symbols on a combined frame.

The control unit 10 checks the symbol arrangement data at step S46, and determines whether a combining condition relating to the symbol arrangement on the main slot 101*a* is established. In this case, when the same type of symbols is arranged on adjacent two frames 104 on the winning line, the determination is made that the combining condition is established. That is to say, when the same type of two symbols is adjacent to (continue) each other in one direction without via another type of symbols, the combining condition is established. The determination is made as at step S41, namely, when the winning combination is not formed, the process at step S46 is executed. Therefore, symbols to be determined whether the combining condition is established do not include symbols which achieve the winning combination as the winning condition. When the combining condition is established at step S46, the control unit 10 goes to next step S47, and sets two frames on which symbols for establishing the combining condition are arranged as a combined frame 104*a* (see FIG. 15) on which the same type of symbols are arranged at next drawing chance. For example, the combined frame is set by a method for setting a flag for identifying a combined frame on a portion to be treated as the combined frame on the symbol arrangement data. The combined frame is treated as an exception position in the next and after symbol drawings. When the combining condition is not established at step S46, the step S47 is skipped.

The control unit 10 determines at step S48 whether the frame set as the combined frame is present on the main slot 101*a*. When the combined frame is present, the control unit 10 goes to step S49, and performs the main slot drawing (hereinafter, combined frame drawing). In the combined frame drawing, symbols that should appear on the frames 104 are drawn using the main slot drawing table TB2 similarly to the main slot drawing; however, the drawing is controlled so that a symbol is drawn for the one frame representing the combined frame and the symbols whose type is the same as that one are drawn for the other frame of the combined frame. Representative one frame may be a frame where a symbol is drawn earlier in the main slot drawing. At the time of the combined frame drawing, as shown on the upper stage of the symbols in FIG. 15, a form of symbols is changed so that symbols on the combined frame 104*a* are connected, and the symbols in the connected state rotate on the combined frame 104*a* (at the middle stage in FIG. 15) according to the starting of the drawing, and finally as shown on the lower stage, the drawn symbols are connected to each other so as to appear. When the combined frame is not present at step S48, the control unit 10 returns to step S32, and executes the processes after the main slot drawing again.

When the number of free games is 0 at step S44, namely, when free symbols do not move to the main slot 101*a* and the free game is not started, or when the free game is ended, the control unit 10 goes to step S50, and initializes odds, namely, by resetting the correspondence relationship between the line winning combinations and the odds to the correspondence relationship in the initial state described above. Further, when a free symbol is present on the reserve area 101*b* at step S50, the control unit 10 updates the reserve area data so that the free symbol present on the reserve area 101*b* is changed into a normal symbol. In this case, a normal symbol which is allowed to appear on the reserve area may be drawn by using a random number. Further, at the time of the process at step S50, when the combined frame is present on the main slot 101*a*, the control unit 10 cancels the setting of the combined frame. That is to say, the control unit 10 cancels the setting of the combined frame as the exception position. When the process at step S50 is completed, the control unit 10 ends the free game process, and returns to the game process in FIG. 3. When symbols arranged on the combined frame with the combined frame being set are used for achieving a winning combination, the determination at step S33 or S41 is made as "yes", and the symbols arranged on the combined frame are erased at step S35. In this case, at step S35, the control unit 10 cancels the setting of the combined frame as the exception position in cooperation with the erasing of the symbols on the combined frame.

According to the free game process described above, in the state in which the free game is not yet started and free symbols appear on the reserve area 101*b*, a winning combination is established in the main slot drawing at step S32, and the free symbols move from the reserve area 101*b* to the main slot 101*a* according to the erasing and movement of the symbols. As a result, the number of free games is set according to the number of the moved free symbols, and the free game is started. When the free game is started, the symbols on the frames 104 of the main slot 101*a* are drawn by the process at step S32 or S49, and dividend is given to the player every time when the winning combination is achieved until the number of free games is determined as 0 at step S44. That is to say, in the normal game process of FIG. 5, when a winning combination is not achieved, the game is ended, however when the free game is started, even if a winning combination is not achieved or the player does not bet medals, the drawing on the main slot 101*a* is repeated, and a chance of obtaining dividend is given to the player. As a result, the sense of expectance for obtaining larger dividends than the normal game is given to the player, so that enjoyment of the game can be heightened.

Further, even when a winning combination is not achieved in the free game, in the case that the same type of symbols are arranged on the adjacent two frames 104, the processes at steps S46, S47, S48 and S49 are allowed to proceed. As a result, in the next main slot drawing, the same type of symbols is necessarily arranged on the combined frame. Therefore, the probability of achievement of a line winning combination or a connect bonus winning combination is heightened, so that the user's sense of expectancy for obtaining a dividend can be further heightened. Further, after the correspondence relationship between the line winning combinations and the odds is repeatedly changed and the odds are changed to the maximum value, the odds are not reset to the initial state so as to be maintained at the maximum value. Therefore, the player can expect more dividends, and the larger the number of free games is, the higher the expectancy becomes. As a result, the excitement of the game can be heightened.

Figure 16:
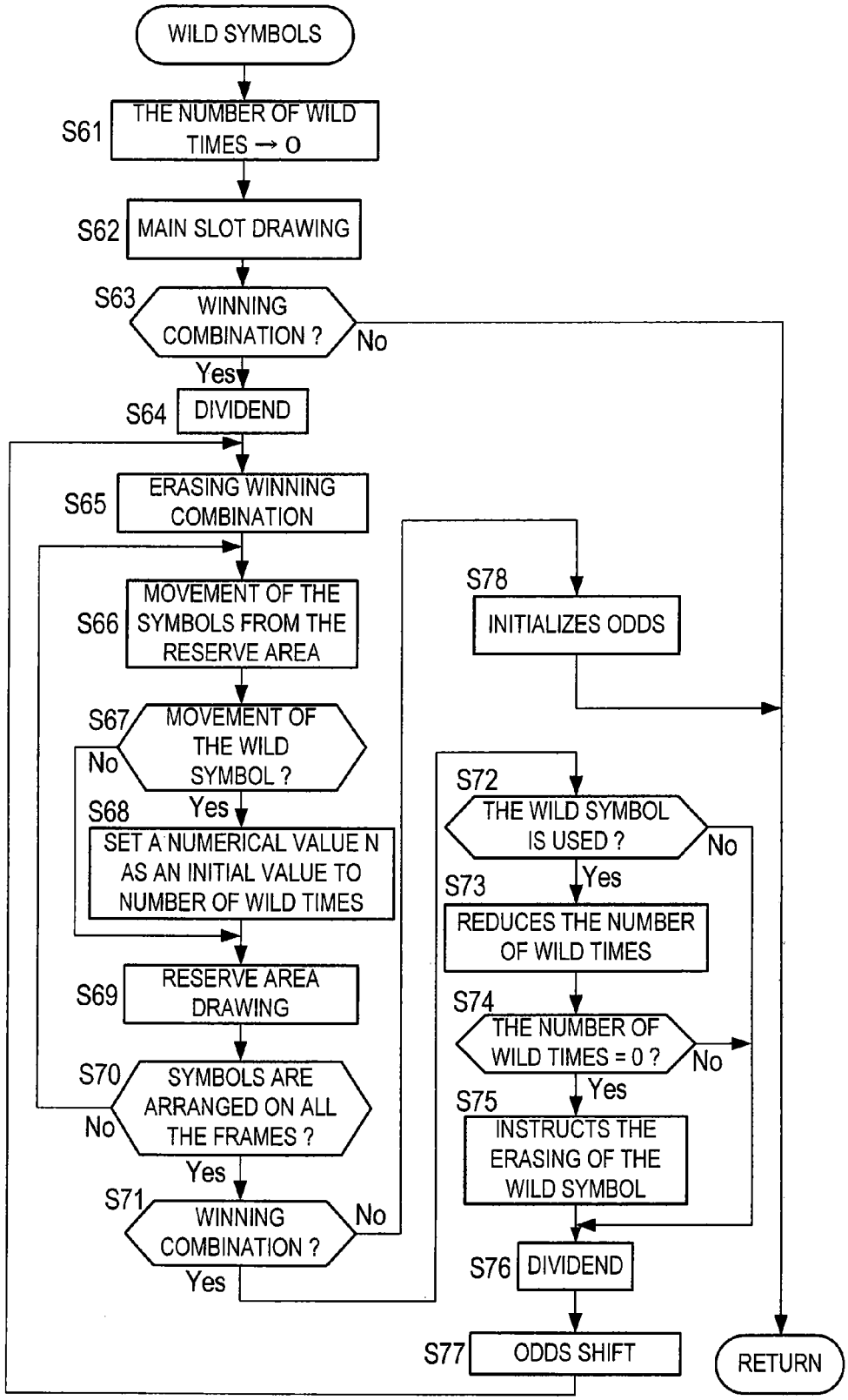
FIG. 16 is a flow chart illustrating a wild symbol process.

A wild symbol process is described below with reference to FIG. 16 and explained in the context of FIGS. 19A-19E The wild symbol process in FIG. 16 corresponds to the subroutine process to be executed at step S7 in FIG. 3. That is to say, when a wild symbol 170 appears on the reserve area 101*b* as a result of the special symbol drawing, the wild symbol process in FIG. 16 is executed. The wild symbol 170 functions as a common symbol that is available for use as any normal symbol in the determination of success or failure of a winning combination on the main slot 101*a*. The number of effective times set for the wild symbol is a value obtained by quantifying an effective range where the wild symbol is available for use as any normal symbol.

Figures 19A, 19B:
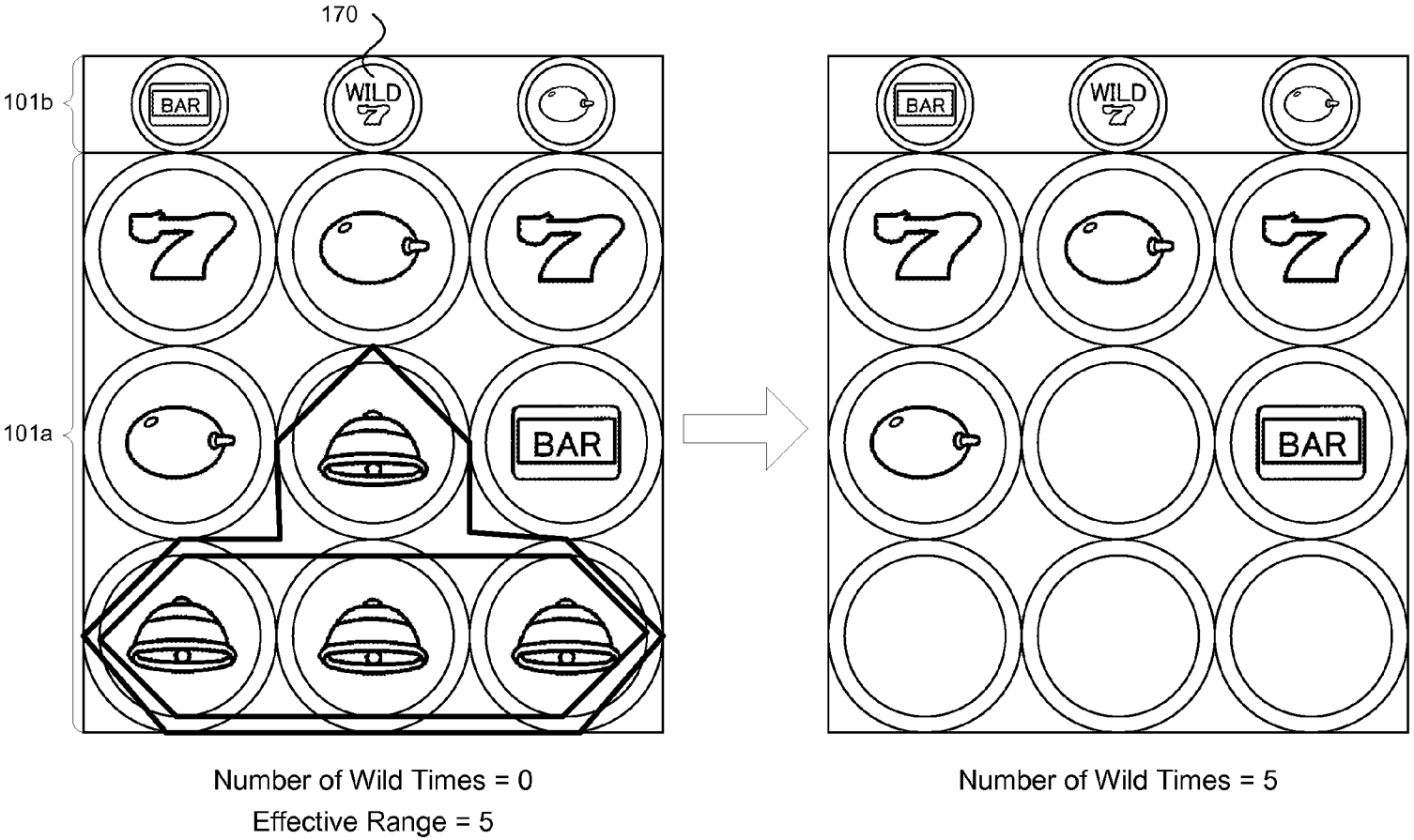
FIGS. 19A-19F are diagrams illustrating arrangement and processing of wild symbols according to another embodiment of the invention.
Figure 19C:
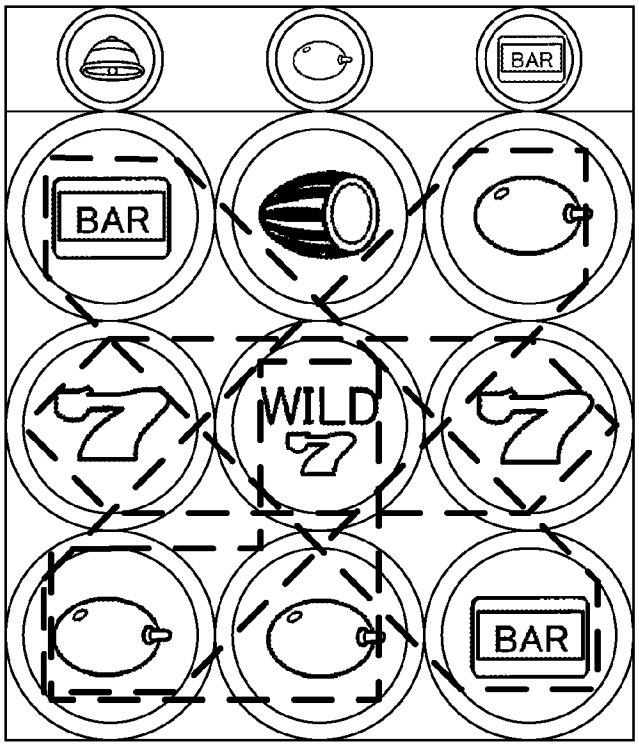
Figure 19D:
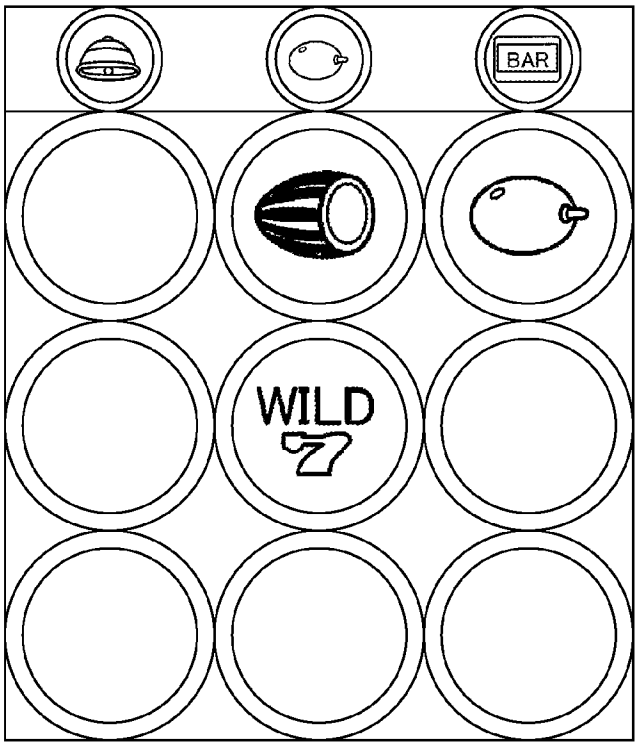

At a first step S61 in the wild symbol process depicted in FIG. 19A, the control unit 10 sets a value of the number of wild times saved in the main storage device 12 to an initial value 0. The number of wild times means the number of times at which a wild symbol is used as a part of a symbol group forming a winning combination on the main slot 101*a*. As depicted in FIG. 19C, the winning combination may be a line winning combination or a connect bonus winning combination. Steps S62 to S66 are similar to steps S11 to S15 in the normal game process of FIG. 5, and the description thereof is omitted. However, when erasing of symbols of a winning combination at step S65, a wild symbol is not erased as long as the number of wild times is not 0 as seen in FIG. 19D in contrast with FIG. 19F. After the process for moving symbols from the reserve area 101*b* to the main slot 101*a* at step S66 is performed, the control unit 101 goes to step S67, and then determines whether a wild symbol moves from the reserve area 101*b* to the main slot 101*a*. The determination of whether the wild symbol moves can be made by updating the symbol arrangement data according to movement of the symbol or the reserve area data just before the movement.

When the determination is made at step S67 that the wild symbol moves, the control unit 10 goes to step S68, and then resets a numerical value N representing the number of effective times of the moved wild symbol as an initial value of the number of wild times saved in the main storage device 12. Thereafter, the control unit 10 goes to step S69. When the determination is made at step S67 that the wild symbol does not move, step S68 is skipped.

Steps S69 to S70 are similar to steps S16 to S17 in the normal game process in FIG. 5, and the description thereof is omitted. A process at step S71 is similar to step S18 in FIG. 5 in that the symbol arrangement data is checked and a determination is made whether a winning combination is achieved on the main slot 101*a*. A process, which is different from step S18 in that the wild symbol 170 is regarded as corresponding to any normal symbol and the determination as to the success or failure of the winning combination is made, is executed at step S71. That is to say, when the success or failure of a line winning combination is determined, the determination is made that the line winning combination is achieved when two symbols excluding the wild symbol 170 match with each other on any winning line including the wild symbol 170. Symbols, which are arranged on frames adjacent to the frame with the wild symbol 170 in the up-down direction, the right-left direction and the diagonal direction, are examined, and when the same type of symbols are present on adjacent two frames, the determination can be made that the connect bonus winning combination is achieved by using the symbols and the wild symbol 170 arranged on the frames.

FIG. 17 illustrates one example of a state of the slot display section 101 when a winning combination using the wild symbol 170 is achieved. In this example, a wild symbol 170 is arranged on the center of the main slot 101*a*. The wild symbol 170 and the symbol "orange" arranged on upper left and lower right frames form the line winning combination. The wild symbols 170 and the symbols "bell" arranged on the left and lower left frames form the connect bonus winning combination.

As is clear from FIG. 17, when the wild symbol 170 is arranged on the center of the main slot 101*a*, the winning line where the line winning combination including the wild symbol 170 can be achieved includes one up-down line and one right-left line centered on the wild symbol 170, and two diagonal lines, and thus the total number is four. Symbols on eight frames adjacent to the wild symbol 170 in the up-down, right-left and diagonal directions including the wild symbol 170 might form the connect bonus winning combination. When the wild symbol 170 is arranged on the center of any one of a upper side, a lower side, a left side and a right side of the main slot 101*a*, the winning lines, where a line winning combination including the wild symbol 170 can be achieved, include two lines composed of the up-down and right-left lines, and the connect bonus winning combination including the wild symbol 170 might be formed by symbols on the five frames around the wild symbol 170. When the wild symbol 170 is arranged on any one of corners of the main slot 101*a*, the winning line where the line winning combination can be achieved includes three lines composed of one diagonal line direction including the corner with the wild symbol 170, one up-down line and one right-left line.

Only symbols on the frames adjacent to the wild symbol 170 are used for the connect bonus winning combination. As is clear from the above, when the wild symbol 170 is arranged on the center of the main slot 101*a*, a chance for using the wild symbol 170 for the achievement of the winning combination is maximized, and the probability of the achievement of the winning combination becomes higher accordingly. Because the movement of symbols from the reserve area 101*b* to the main slot 101*a* is limited to the up-down direction, in order to arrange the wild symbol 170 on the center of the main slot 101*a*, the wild symbol 170 must be arranged on the center of the reserve area 101*b*. Therefore, when a position where the wild symbol should be allowed to appear in the reserve area drawing is determined, the probability of appearance of the wild symbol may be set smaller on the center of the reserve area 101*b* than both the ends.

The description is continued with reference to FIG. 16. When the winning combination is achieved at step S71, the control unit 10 goes to next step S72, and determines whether the wild symbol 170 is used for achieving the winning combination. When the wild symbol 170 is used, the control unit 10 regards that a consumption condition about the number of effective times of the wild symbol 170 is established, and goes to step S73, and reduces the number of using times of the winning combination from the value of the number of wild times saved in the main storage device 12 as depicted in FIG. 19C. Therefore, the control unit 10 goes to step S74. The number of using times is counted in such a manner that one winning combination is counted as one time. In the example of FIG. 17, since the wild symbol 170 is used for one line winning combination and one connect bonus winning combination, the number of using times is 2. In this case, therefore, the number of wild times is reduced by 2. When the number of wild times is reduced at step S73, the control unit 10 updates the numerical value N of the wild symbol 170 displayed on the main slot 101*a* to the value after the reduction.

Figure 19F:
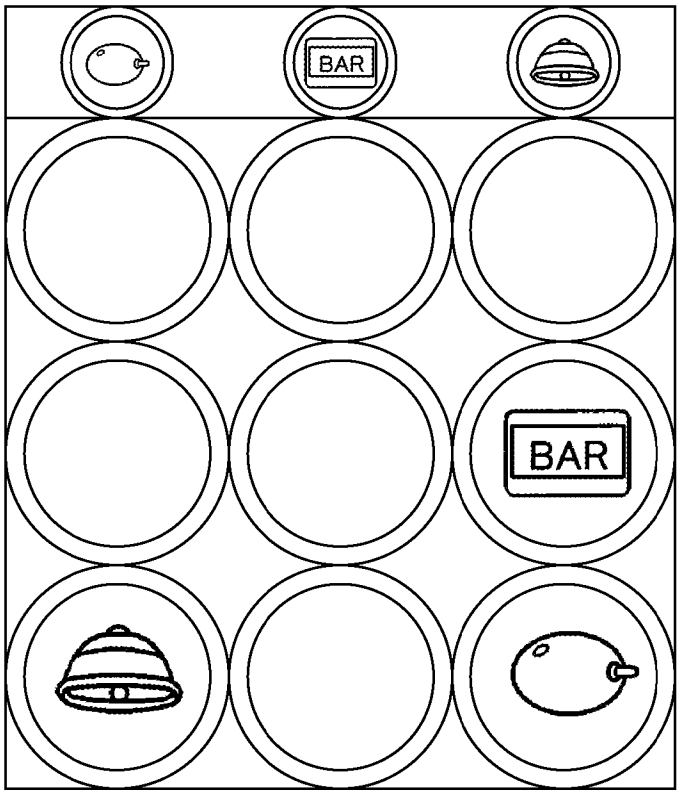
Figure 19E:
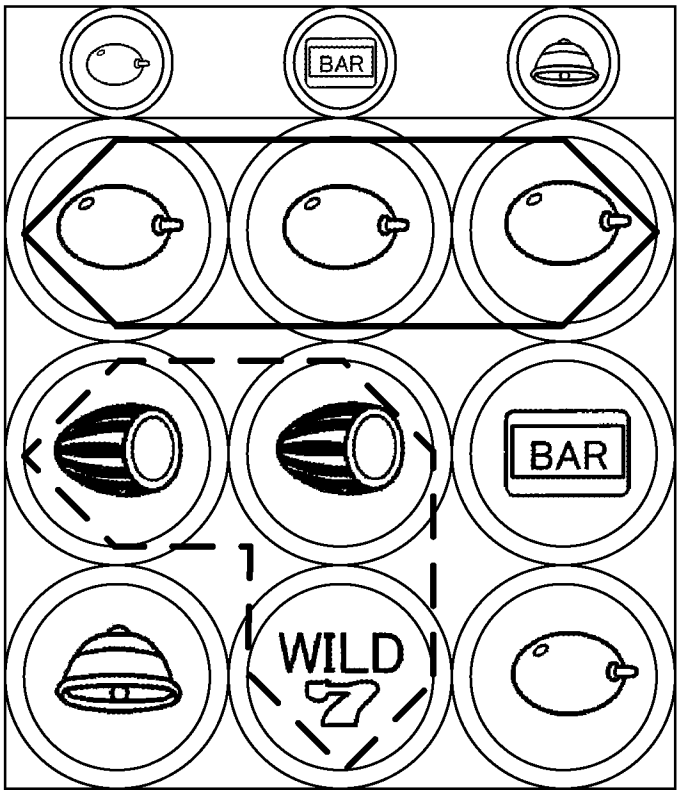

The control unit 10 determines whether the number of wild times is 0 at step S74. When the number of wild times is 0, the control unit 10 goes to next step S75, and instructs the erasing of the wild symbol 170 from the main slot 101*a* as depicted in FIGS. 19E and 19F. In response to this instruction, the wild symbol 170 is erased from the main slot 101*a* at step S65 to be executed later. When the number of using times is not 0 at step S74, the control unit 10 skips step S75 to step S76 and the wild symbol remains in the main slot 101*a* as depicted in FIGS. 19C and 19D. Steps S76 and S77 are similar to steps S19, S20 and S21 in the normal game process in FIG. 5, and the description thereof is omitted. Odds are initialized at step S77, and then the control unit 10 returns to step S65. When a winning combination is not achieved at step S71, the control unit 10 goes to step S78, and initialize the odds similarly to step S21 of FIG. 5. At this time, when the wild symbol remains on the reserve area 101*b*, the wild symbol is erased and is changed into a normal symbol. Random numbers can be used for the normal symbol drawing in this case. When the odds are initialized at step S78, the control unit 10 ends the process in FIG. 16, and returns to the game process in FIG. 3.

According to the wild symbol process described above, the wild symbol moves from the reserve area 101*b* to the main slot 101*a*, so that the probability of the achievement of a winning combination rises. Therefore, the sense of expectance for obtaining larger dividends than the normal game is given to the player, and thus the excitement of the game can be heightened. Further, in the present embodiment, the number of effective times N is set for the wild symbol, and the number of effective times is reduced one by one every time when the wild symbol is used for achieving a winning combination, and the probability of the achievement of a winning combination is maintained high until the number of wild times becomes 0, namely, the number of effective times of the wild symbol is consumed. For this reason, in comparison with the case where the wild symbol can be used only once for the achievement of the winning combination, the user's sense of expectation for obtaining winning and dividend is enhanced, so that the excitement of the game can be further heightened. In comparison with a case where the number of effective times is not set for the wild symbol and the wild symbol is allowed to remain continuously until a winning combination is not achieved and a next medal should be put into, the high probability is in no danger of becoming unnecessarily prolonged. Therefore, the winning probability or the expectance value of dividend due to common symbols can be controlled flexibly and suitably. The larger the number of effective times N of the wild symbol becomes, the lower the probability of appearance of the wild symbol on the reserve area 101*b* is set. As a result, the change in the probability due to wild symbol can be controlled more suitably.

In the above embodiment, the control unit 10 functions as a first game chance control device, a divided value control device, a divided display control device, a dividend generating device and a condition determining device, and a main storage device 12 of the control unit 10 functions as a dividend candidate data retaining device. Concretely, the control unit 10 goes through steps S1, S2 and S5 in FIG. 3 and proceeds to step S11 in the normal game process in FIG. 5, and thereby functions as the first game chance control device. The control unit 10 makes the determination as "yes" at step S12 and executes steps S14 to S17, and thereby functions as the first game chance control device for generating an additional game chance. The control unit 10 executes steps S13 and S19, and thereby functions as the dividend generating device, and executes step S18, and thereby functions as the condition determining device, and executes steps S20 and S21, and thereby functions as the dividend value control device and the dividend display control device.

The control unit 10 proceeds to step S32 via steps S1, S2, S5 and S6 in FIG. 3 and step S31 in FIG. 12, or proceeds to step S62 via steps S1, S2 and S3 in FIG. 3 and step S61 in FIG.

16, and thereby also functions as the first game chance control device. When the free game process in FIG. 12 is executed, the control unit 10 executes steps S35 to S40 in response to the determination as "yes" at step S33, and thereby functions as the first game chance control device for generating an additional game chance, executes steps S34 and S42, and thereby functions as the dividend generating device, executes step S41, and thereby functions as the condition determining device, and executes steps S43 and S50, and thereby functions as the dividend value control device and the dividend display control device. When the wild symbol process in FIG. 16 is executed, the control unit 10 executes steps S65 to S70 in response to the determination as yes at step S63, and thereby functions as the first game chance control device for generating an additional game chance, executes steps S64 and S76, and thereby functions as the dividend generating device, executes step S71, and thereby functions as the condition determining device, and executes steps S77 and S78, and thereby functions as the dividend value control device and the display control device.

Figure 18:
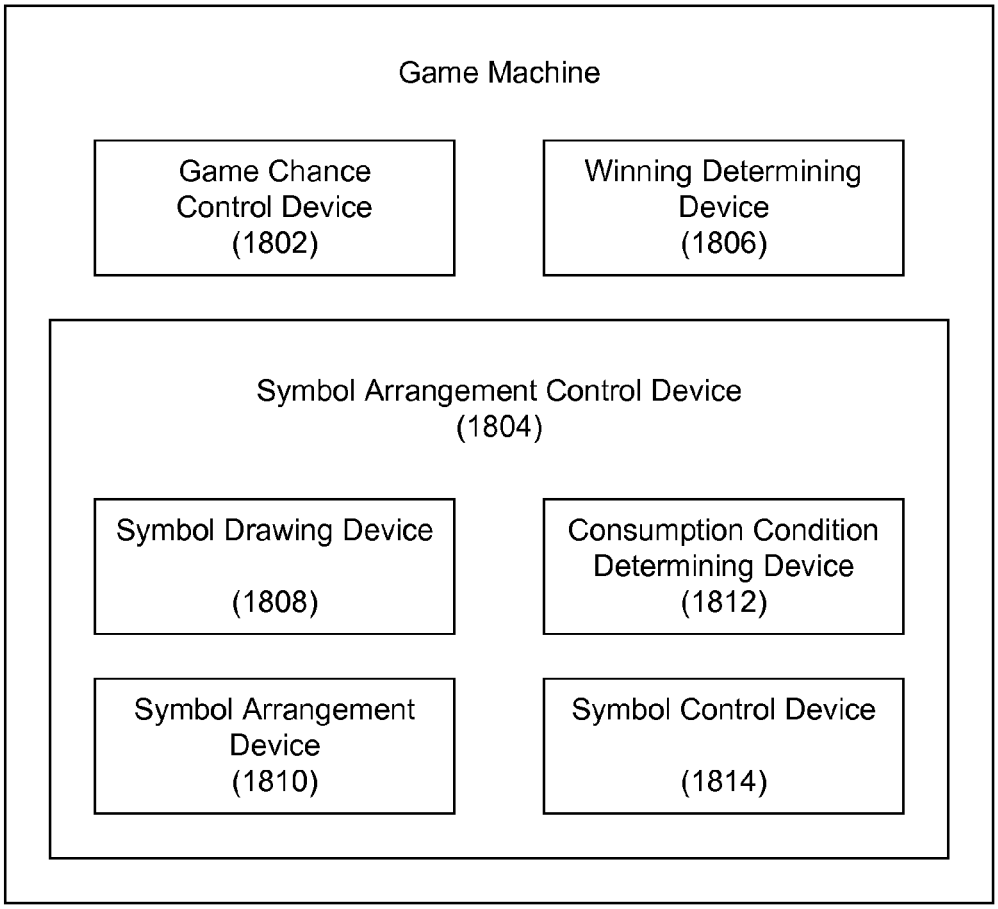
FIG. 18 is a diagram illustrating a game machine according to another embodiment of the present invention.

Further, the control unit 10 executes the game process in FIG. 3 and the wild symbol process in FIG. 16 as the subroutine process, and thereby functions as a game chance control device 1802, a symbol arrangement control device 1804, a winning determining device 1806, a symbol drawing device 1808, a common symbol arrangement device 1810, a consumption condition determining device 1812, a symbol control device 1814 and a symbol presenting device 1816 as depicted in FIG. 18. Concretely, the control unit 10: proceeds to step S62 in FIG. 16 via steps S1, S2, S5 and S6 in FIG. 3 in response to a game starting signal from the start button 2, and thereby functions as the game chance control device 1802 for generating a first game chance; executes step S65 in FIG. 16, and thereby functions as the game chance control device 1802 for generating a new game chance or next and after game chances in the game within the same range; and ends the process in FIG. 16 in response to the determination as no at step S71 in FIG. 16, and thereby functions as the game chance control device 1802 for ending the game within a predetermined range. Further, the control unit 10 executes step S1 in FIG. 3, step S62 in FIG. 16, and steps S66 to S70, and thereby functions as the symbol arrangement control device 1804. Particularly the control unit 10 executes: step S1 in FIG. 3, and thereby functions as the symbol drawing device 1808; executes step S66 in FIG. 16, and thereby functions as the symbol arrangement device 1810; executes step S72, and thereby functions as the consumption condition determining device 1812; and executes steps S73 to S75 and erases a wild symbol at step S78, and thereby functions as the symbol control device 1814. Further, the control unit 10 executes step S6 in FIG. 3, and thereby functions as the symbol presenting device 1816.

The control unit 10 executes the game process in FIG. 3 and the free game process in FIG. 12 as the subroutine process, and thereby functions as a drawing chance control device, a symbol drawing device, a second winning determining device, a exception condition determining device, an exception processing device, an additional chance generating device, a number-of-redrawing chances drawing device, and a game end control device. Concretely, the control unit 10: proceeds to step S32 in FIG. 12 through steps S1, S2 and S3 of FIG. 3 in response to the game starting signal from the start button 2, and thereby functions as the drawing chance control device for generating a first drawing chance about the symbol arrangement on the main slot 101*a*; executes step S32 in FIG. 12, and thereby functions as the symbol drawing device, executes steps S33 and S41, and thereby functions as the second winning determining device; executes step S46, and thereby functions as the exception condition determining device; and executes sequentially steps S47, S48 and S49, and thereby functions as the exception processing device for arranging the same type of symbols on exception positions.

When at least one free symbol is drawn in the reserve area drawing at step S1, a winning combination is achieved at step S33 and a free symbol moves to the main slot area 101*a* at step S37, the control unit 10 determines that a redrawing condition is established. After the establishment of the redrawing condition, the control unit 10 generates additional chances of the main slot drawing at steps S32 or S49 until the determination is made as "yes" at step S44, and thereby functions as the additional chance generating device. The control unit 10 draws a symbol from choices including free symbols whose number of free games varies in the exception symbol drawing at step S1 in FIG. 3, and adds the number of free games according to the number of free symbols moved to the main slot 101*a* at step S38 in FIG. 12, and thereby functions as the number-of-redrawing chances drawing device. When the determination is made as "no" at step S33, namely, the winning condition is not established in the additional drawing chance, the control unit 10 performs the main slot drawing at step S49 continuously until the winning condition is established and the determination is made as "yes" at step S33 or S41 as long as the determination is not made as "yes" at step S44. When the arrangement of the same type of symbols on the exception positions (combined frame) continues and the winning condition is established so that the determination is made as yes at step S33 or S41, the control unit 10 erases a symbol on the exception position at step S35, and thereby functions as the exception processing device for canceling the exception position.

The present invention can be carried out in various forms without being limited to the above embodiment. In the above-described embodiment, the correspondence relationship between the winning combinations and the dividend values is changed so that when the odds candidate data D1 is prepared as the dividend value candidate data, and the range of the selected odds group (selected dividend value group) set on the data D1 is shifted by one odds candidate value from the head to the tail end, the column of odds as the dividend values shift to the one end side (lower end) on the divided list one by one. However, as long as the column of the divided value on the divided list shifts to one end side in the arrangement direction of a winning combination and a new dividend value is credited to a blank generated on the other end of the arrangement direction on the dividend list, the correspondence relationship between the winning combinations and the divided values may be changed by a suitable method. For example, dividend tables into which the correlations relationship between the winning combinations and the divided values is written is created in advance and is saved in the external storage device 13, and every time when a dividend change condition is established, the selection of the dividend table is switched so that the divided value on the divided list can be changed.

As long as the dividend values make the player understand the dividend in the case where winning combinations are achieved, they are not limited to odds and may be the number of dividends or the dividend amount or the like. A shift amount of column of the divided value on the divided list is not limited to a space for one dividend value. Every time when the divided change condition is established, the column of the dividend values may be shifted by spaces for two divided values. When the odds candidate data D1 is used, a shift amount of the selected odds group in the case where the divided change condition is established may be set to spaces for two or more divided candidate values. The shift amount of the dividend values may be changed according to the condition such as a shift amount of the column of divided values is set larger than normal when an exception dividend change condition is established.

In the embodiment described above, the dividend values related to the winning combinations with high achievement probability are set to be larger than the divided values related with winning combinations with low achievement probability, however the divided values related to some winning combinations may be set exceptionally lower than the divided values related with the other winning combinations with higher establishment probability than the former winning combinations.

In the embodiment described above, a new divided value displayed on the next odds display section 102*b* as well as odds related with a winning combination is determined from the odds candidate data D1, however the new divided value may be determined by a suitable method. For example, a divided value displayed on the next odds display section 102*b* may be determined by using a random number.

In the embodiment described above, the column of the dividend values related with the line winning combination is sequentially shifted according to the establishment of the dividend change condition, however the column of dividend values related with another winning combination can be shifted similarly. The present invention can be applied to various games that generate winning combinations with various probabilities including games which form winning combinations by means of combinations of symbols. Various dividend change conditions may be set without being limited to the formation of winning combinations. Winning combinations as winning conditions are not limited to the line winning combinations and the connect bonus winning combinations. Types and arrangements of symbols for achieving winning combinations may be changed suitably. The positional relationship of symbols arranged on predetermined areas on the game screen is not limited to the example where the same number of symbols is arranged into a matrix pattern in the vertical and lateral directions, for example a positional relationship such that symbols are arranged laterally on a line may be set. Further, the achievement of the winning combinations are not limited to the method based on the types and arrangements of symbols, however this form may be variously changed.

In the above embodiment, the processes from the starting through the ending of the game process in FIG. 3 are set as a game within a predetermined range, and a first game chance is given in the game and the reserve area drawing (step S1) is performed at this game chance, and thereby a chance for drawing wild symbols as common symbols is given. When symbols are arranged on the main slot 101*a* as the predetermined area so that a winning combination is achieved at the first game chance, namely, the winning condition is established, the symbols for achieving the winning combination are erased (step S65), and a new game chance is generated by a method for rearranging symbols (steps S66 to S70). Further, a game chance is repeatedly generated until the winning condition is not established in a new game chance, and a chance for arranging wild symbols on the main slot 101*a* is generated at any one of these game chances. Further, after the wild symbols are arranged on the main slot 101*a*, it is regarded that the winning condition is established every time when the wild symbols are used for the establishment of the winning condition, and thus the number of effective times is reduced one by one (step S73). When the number of effective times is consumed, the wild symbols are erased from the main slot 101*a* (steps S74 and S75). However, the various processes, such as the common symbol drawing, the arrangement of the drawn common symbols, reduction in the effective range of the common symbols and the erasing of the common symbols, the control of generation of game chances, and types and arrangement of symbols on predetermined areas, can be suitably changed.

The common symbol drawing is not limited to the example that the drawing is performed only at the first game chance, it may be possible to change to the example that every time when a game chance is generated, at least one symbol can be drawn as a symbol to be arranged on the predetermined area from the symbol candidates including normal symbols and common symbols. For example, in the reserve area drawing at step S69 in FIG. 16, wild symbols may be included in candidates to be drawn. In another manner, besides the process for moving a symbol from the reserve area 101*b* to the blank frame 104 on the main slot 101*a*, a new symbol to be arranged on the blank frame 104 may be drawn from the symbol candidates including wild symbols by using a random number.

The common symbol arrangement is not limited to the example that a wild symbol is moved from the reserve area 101*b* to the blank frame 104. For example, when common symbols are drawn at a specific game chance, the common symbols may be arranged on the predetermined area unconditionally at the specific game chance. The arrangement is not limited to the example that a new common symbol is moved to the blank frame 104, and the common symbols may be arranged so as to replace the normal symbols remaining on the predetermined area.

The reduction in the number of effective times of the common symbols is not limited to the example that every time when the common symbols are used for the establishment of the winning condition, the consumption condition is established and thus the number of effective times is reduced one by one. For example, every time when a game chance is generated, the consumption condition is established, and the number of effective times may be reduced regardless of the success or failure of the winning condition. For example, the larger the dividend related with the winning condition established by the common symbols is, the more the reduction amount of the number of effective times is increased so that the reduction amount of the effective times at the time when the consumption condition is established once may be changed. The effective range of the common symbols is not limited to the example defined by the number of effective times. The effective range of the common symbols is defined by time, and after the common symbols are arranged on the predetermined area, the effective range (in this case, remaining time) may be reduced every time that a predetermined unit time passes. The effective range may be reduced by using two kinds of elements such as the number of times and the time.

Common symbols should be indispensably erased when the effective range is consumed, and on the other hand, when one game, namely, a game within a predetermined range provided in exchange for a game value is ended, the common symbols may be allowed to remain for the next game without erasing the common symbol. That is to say, the present invention is not limited the embodiment that game chances are generated in a game within a predetermined range, common symbols are allowed remain on the predetermined area only at these game chances until the effective range is consumed. For example, also at least one game chance is generated in the games, and common symbols may be allowed to remain on the predetermined area at these game chances until the effective range is consumed. When common symbols are erased at the time when the game provided in exchange for a game value is ended, the common symbols remain at the time of starting a next game, and thus the probability of the establishment of a winning condition is in no danger of becoming high in an initial state. On the other hand, when the common symbols are allowed to remain until next game, the presence of the common symbols can give motivation for starting the next game to the player.

In the above embodiment, the game chance is again generated via steps S72 to S77, and thereafter, a game chance is repeatedly generated as long as a winning condition is established. However, the present invention is not limited to the example that a game chance is generated by such a method. The condition for generating a new game chance is not limited to a winning condition, and may be suitably changed. For example, a game different from the game using the main slot 101*a* is played as the game within the same range, and when a predetermined result is obtained in another game, a new game chance may be generated.

In the above embodiment, the types of symbols arranged on all the frames 104 are determined by random numbers at the first game chance, and the types of symbols on the main slot 101*a* as the predetermined area are determined by the movement of a symbol to the blank frame 104 and the reserve area drawing at next and after game chances, namely, second and subsequent game chances generated by the establishment of the winning combination. However, the method for determining the types of symbols at the respective game chances can be changed variously. For example, the reserve area 101*b* is omitted, and a type of a symbol arranged on a frame 104 to be blank due to the erasing of a symbol may be drawn by a random number at the respective game chances. In another manner, every time that a game chance is generated, symbols on all the frames 104 may be drawn by random numbers. In this case, the common symbol whose number of effective times remains may be allowed to remain on any frame 104 of the main slot 101*a* by way of exception.

The present invention is not limited to the example that a common symbol is available as all normal symbols, and a common symbol may be available as two or more types of normal symbols. The present invention is not limited to the example that common symbols whose effective range varies is prepared in advance, for example, initial values of the effective ranges of the common symbols may be fixed to a constant value. The positional relationship of symbols on the predetermined area on the game screen is not limited to the relationship where the same number of symbols is arranged into a matrix pattern in vertical and lateral directions, and may be variously changed. For example, a positional relationship that symbols are arranged in one lateral line may be set. The winning combination as the winning condition is not limited to the line winning combination and the connect bonus winning combination. Types and array (arrangement) of symbols for establishing the winning condition may be suitably changed.

In the above embodiment, the processes from the starting to the ending of the game process in FIG. 3 are set as the game within predetermined range provided to the player in exchange for a game value. After the game is started, a chance that is allowed to draw one to three free symbols is given in the reserve area drawing (step S1), and when free symbols are drawn in the reserve area drawing, the process in FIG. 12 is started, and the first drawing chance is given at step S32. When a winning combination is achieved and a winning condition is established at the first drawing chance and the free symbols are moved to the main slot 101*a* due to erasing of the symbols according to the establishment of the winning condition, a redrawing condition is determined as being established (steps S33 to S37). When the redrawing condition is established, the number of free games is set to 5 or more (see FIG. 13), and thereby additional drawing chances (steps S32 or S49) are generated in one game. After a combined frame as an exception position is set at the additional drawing chance, the combined frame drawing is repeated at step S49 until the same type of symbols arranged on the combined frame are used for achieving a winning combination and the same type of symbols are repeatedly arranged on the exception position as long as the free game is determined as being ended at step S44. However, the control of generation of the drawing chance, contents and the correlation between the winning condition and the exception condition, contents of the redrawing condition, and starting and ending of treatment as the exception position can be changed suitably.

In the above embodiment, the drawing chance for arranging symbols on the predetermined area is generated only once at step S32 after the starting of the game, and a new drawing chance is not generated as long as a winning condition is not established at the one drawing chance. Even when the winning condition is established, second and subsequent drawing chances, namely, additional drawing chances are generated only when both two requirements other than the redrawing condition that at least one free symbol is drawn in the reserve area drawing and the free symbol moves to the main slot 101*a* are filled. Further, the combined frame drawing (step S49) as the exception process for arranging the same type of symbols on the exception position is limited to an additional drawing chance. However, the requirements of the redrawing condition are not limited to the above example, and may be changed suitably. For example, when specific symbols are arranged correspondingly to the first drawing chance, the winning condition is established as a premise, or the redrawing condition is determined as being established without a premise, and thereby an additional drawing chance may be generated. A game different from the game using the main slot 101*a* is played concurrently, and when a predetermined result is obtained in this game, a redrawing condition is determined as being established, and thereby an additional drawing chance may be generated.

In the above embodiment, one drawing chance is generated after the starting of a game, and when a winning combination is achieved, symbols are erased and moved, and thereby the symbol arrangement is updated, and a chance that is allowed to achieve a winning combination is additionally generated. That is to say, in the above embodiment, one game chance for achieving a winning combination on the main slot 101*a* as the predetermined area is generated, and when a winning condition is established at that game chance, the symbol arrangement is updated, and then at least one game chance that is allowed to achieve a winning combination is additionally generated. When a free symbol is moved to the main slot 101*a* at the additional game chance, additional drawing chances are generated according to the number of movements of the free symbol. However, in the present invention, the process for generating an additional game chance is not always necessary.

The second and subsequent drawing chances are not limited to the example that the chances are given as additional drawing chances given on the premise that a redrawing condition is established. It may be possible to change to the example that after the starting of a game, drawing chances are generated unconditionally, and when an exception condition is established at a drawing chance before the final one, symbols on the exception position can be treated continuously as symbols on the exception position until those symbols are used for establishing the winning condition at the next and after drawing chances. As is clear from such a form, in the present invention, the redrawing condition may be omitted. The number of generating times of the drawing chance is drawn at the starting of the game, and only when 2 or more is drawn, the success or failure of the specific condition may be determined and the chances may be treated as the exception position. Further, in the above embodiment, drawing chances are generated in one game provided in exchange for a game value, and the same type of symbols are arranged on the exception position only within a range of the drawing chances, however the drawing chances are not limited to the example that the drawing chances are generated in the game within the same range. For example, the number of drawing chances to be generated in one game is limited to 1, and when the exception condition is established at this drawing chance, the same type of symbols may be arranged on the exception position in the next and after games.

In the above embodiment, at the time when a winning combination is not achieved at step S33 or S41, the number of residual free games is determined at step S44, and only the case of the free game, presence and non-presence of the combined frame is determined at step S46. Therefore, as described above, the determination is made whether the exception condition is established as to all the frames on the main slot 101*a*. However, even when a winning combination is achieved, a determination is made whether the combining condition (exception condition) is established for symbols other than the symbols used for the achievement in the winning combination, and the frames where the combining condition is established are set as a combined frame (exception position), and then the same type of symbols may be arranged on the next and after drawing chances. That is to say, the symbols excluding the symbols establishing the winning condition may be analyzed to determine the success or failure of the exception condition.

The positional relationship of the symbols on the predetermined area on the game screen is not limited to the relationship that the same number of symbols is arranged vertically and laterally into a matrix pattern, and can be variously changed. For example, the symbols can be arranged laterally in one line. The winning combination as the winning condition is not limited to the line winning combination and the connect bonus winning combination. The types and array (arrangement) of symbols for establishing the winning condition may be suitably changed. In the above embodiment, when the same kind of three or more symbols achieve the winning combination, the winning condition is established, and thus the necessary number of winnings is 3. However, the necessary number of winnings may be set to a suitable value which is 3 or more according to the arrangement of symbols on the predetermined area. The number of symbols necessary for establishing the exception condition is not limited to 2, and may be set to a suitable value which is 2 or more according to the necessary number of winnings. Further, the arrangement of the same type of symbols necessary for establishing the exception condition may be a part of the arrangement of symbols necessary for establishing the winning condition, and thus it is not limited to a case where these symbols are adjacent to each other without via another symbol. For example, in the relationship with the line winning combination in the above embodiment, when the same type of symbols are arranged on both the ends of any winning line and different kind of symbols are arranged between the symbols on the ends, the exception condition may be established.

The game value is not limited to medals, and may be various game media such as circulating media and tokens, or may be electronic information such as the number of times recorded in a storage medium. The dividends are not limited to the example realized by paying-out of medals, and may be generated in various forms such as circulating medium or giving of points usable in games. Further, when the winning condition is established, any perquisite may be generated as dividends on the game.

The invention claimed is:

1. A game machine comprising:

a game chance control device adapted and configured to generate at least one game chance that is allowed to establish a winning condition in a game provided to a player;

a symbol arrangement control device adapted and configured to determine types of symbols to be arranged on a predetermined area on a game screen with a predetermined positional relationship according to the generation of the game chance; and a winning determining device adapted and configured to determine whether the winning condition is established based on the types and the arrangement of the symbols arranged on the predetermined area, wherein the symbol arrangement control device comprises comprising:

a symbol drawing device adapted and configured to draw at least one symbol from symbol candidates including normal symbols and wild symbols;

a symbol arrangement device adapted and configured to arrange the symbols drawn by the symbol drawing device on the predetermined area;

a consumption condition determining device adapted and configured to determine whether a predetermined consumption condition is established in the game; and a symbol control device adapted and configured to control arrangement of symbols on the predetermined area so that when the wild symbol is arranged on the predetermined area, the effective range of the wild symbol is reduced every time that the consumption condition is established, and even if a new game chance is generated, the wild symbol remains on the predetermined area until the effective range is consumed, and when the effective range is consumed, the wild symbol disappears from the predetermined area.

2. The game machine according to claim 1, wherein the effective range is defined by a number of effective times, and the symbol control device is adapted and configured to determine that the consumption condition is established every time the wild symbol is used for the establishment of the winning condition, and reduces the number of effective times one by one.

3. The game machine according to claim 1, wherein the winning determining device is adapted and configured to determine that the winning condition is established when a predetermined number of same types of symbols arranged on the predetermined area form a predetermined array.

4. The game machine according to claim 1 wherein the game chance control device is further adapted and configured to:

generate the new game chance in the game when the winning condition is established; and end the game when the winning condition is not established, wherein the symbol control device is adapted and configured to erase the wild symbol from the predetermined area when the winning condition is not established and the wild symbol remains within the effective range.

5. The game machine according to claim 4, wherein the symbol drawing device is adapted and configured to draw symbols from the symbol candidates at any game chance generated in the game, the symbol arrangement device arranges the wild symbol on the predetermined area at a game chance generated at next and subsequent times when the winning condition is established at the game chance at a time point when the symbol drawing device draws the wild symbol.

6. The game machine according to claim 5, further comprising a symbol presenting device adapted and configured to present the drawn wild symbol as a symbol to be arranged on the predetermined area at the game chance generated at the next and subsequent times to the player when the symbol drawing device draws the wild symbol.

7. The game machine according to claim 5, wherein the symbol drawing device draws a symbol from the symbol candidates at the game chance generated first in the game.

8. The game machine according to claim 1 wherein the symbol candidates include wild symbols whose effective range varies.

9. A computer program product embodied on a non-transitory computer readable medium is constituted to allow a computer provided to a game machine to serve as:

a game chance control device adapted and configured to generate at least one game chance that is allowed to establish a winning condition in a game provided to a player;

a symbol arrangement control device adapted and configured to determine types of symbols to be arranged on a predetermined area on a game screen with a predetermined positional relationship according to the generation of the game chance; and a winning determining device adapted and configured to determine whether a predetermined winning condition is established based on the types and the arrangement of the symbols arranged on the predetermined area, wherein the symbol arrangement control device is further adapted and configured to serve as:

a symbol drawing device adapted and configured to draw at least one symbol from symbol candidates including normal symbols and wild symbols;

a symbol arrangement device adapted and configured to arrange the symbols drawn by the symbol drawing device on the predetermined area;

a consumption condition determining device adapted and configured to determine whether a predetermined consumption condition is established in the game; and a symbol control device adapted and configured to control arrangement of symbols on the predetermined area so that when the wild symbol is arranged on the predetermined area, the effective range of the wild symbol is reduced every time that the consumption condition is established, and even if a new game chance is generated, the wild symbol remains on the predetermined area until the effective range is consumed, and when the effective range is consumed, the wild symbol disappears from the predetermined area.

10. A method of determining whether a winning condition is established based on types and arrangements of symbols on a predetermined area, the method comprising:

drawing at least one symbol from symbol candidates including normal symbols and wild symbols;

arranging the at least one symbol drawn on the predetermined area;

determining whether a predetermined consumption condition is established;

controlling arrangement of symbols on the predetermined area so that when the wild symbol is arranged on the predetermined area, an effective range of the wild symbol is reduced every time that the consumption condition is established, and even if a new game chance is generated, the wild symbol remains on the predetermined area until the effective range is consumed; and when the effective range is consumed, removing the wild symbol from the predetermined area.

* * * * *